US011503888B1

(12) United States Patent
Rodrigues

(10) Patent No.: US 11,503,888 B1
(45) Date of Patent: Nov. 22, 2022

(54) CARRIER

(71) Applicant: Tania Rodrigues, San Anselmo, CA (US)

(72) Inventor: Tania Rodrigues, San Anselmo, CA (US)

( * ) Notice: Subject to any disclaimer, the term of this patent is extended or adjusted under 35 U.S.C. 154(b) by 417 days.

(21) Appl. No.: 16/286,432

(22) Filed: Feb. 26, 2019

Related U.S. Application Data

(60) Provisional application No. 62/635,488, filed on Feb. 26, 2018.

(51) Int. Cl.

| | |
|---|---|
| ***A45C 5/03*** | (2006.01) |
| ***A45C 13/03*** | (2006.01) |
| ***A45C 13/00*** | (2006.01) |
| ***A45C 13/02*** | (2006.01) |

(52) U.S. Cl.
CPC ..... *A45C 5/03* (2013.01); *A45C 13/005* (2013.01); *A45C 13/03* (2013.01); *A45C 2013/025* (2013.01); *A45C 2013/026* (2013.01)

(58) Field of Classification Search
CPC ..... A45C 5/03; A45C 13/005; A45C 13/03; A45C 2013/025; A45C 2013/026
See application file for complete search history.

(56) References Cited

U.S. PATENT DOCUMENTS

| | | | | | |
|---|---|---|---|---|---|
| 2,803,281 | A * | 8/1957 | Sutton | A45C 1/06 | 150/138 |
| 2,856,110 | A * | 10/1958 | Cowan | A45C 13/03 | 223/89 |
| 2,893,457 | A * | 7/1959 | Wilson | A45C 13/02 | 29/254 |
| 3,512,621 | A * | 5/1970 | Teetor | A45C 3/004 | 206/287 |
| 4,255,872 | A * | 3/1981 | Williams, Sr. | G09B 5/06 | 206/232 |
| 4,515,493 | A * | 5/1985 | Radovich | A45C 3/02 | 150/110 |
| 6,179,025 | B1 * | 1/2001 | Sutton | A45C 3/08 | 150/105 |
| 6,626,601 | B1 * | 9/2003 | Moor | B42F 11/00 | 150/108 |
| 6,715,594 | B2 | 4/2004 | Milionta et al. | | |
| D690,502 | S | 10/2013 | Bergquist | | |
| 8,702,128 | B2 * | 4/2014 | Rowe | B42F 11/00 | 281/29 |
| 8,820,596 | B1 | 9/2014 | Bergquist | | |
| 9,702,128 | B2 * | 7/2017 | Sawaski | E03C 1/057 | |
| 9,717,322 | B1 | 8/2017 | Bergquist | | |
| 10,028,562 | B2 * | 7/2018 | Matthew | A45C 3/004 | |
| 10,694,834 | B2 * | 6/2020 | Logan | A45F 4/02 | |
| 2008/0060953 | A1 * | 3/2008 | Ghassan | A45C 13/26 | 206/216 |
| 2008/0185250 | A1 * | 8/2008 | Martins | A45C 13/008 | 190/108 |

(Continued)

*Primary Examiner* — Tri M Mai
(74) *Attorney, Agent, or Firm* — R. Dabney Eastham

(57) ABSTRACT

A carrier for articles has a case with an interior compartment that holds sleeves called pages for holding articles. The pages are accessed when the case is opened. The pages are attached to the case inside the compartment so they may be rotated to access either side. The pages may be detached from the case. A kit comprising a case and a number of detachable and varied pages may be employed to construct a carrier according to the needs of the user.

12 Claims, 19 Drawing Sheets

(56) References Cited

U.S. PATENT DOCUMENTS

| | | | | |
|---|---|---|---|---|
| 2013/0175129 | A1* | 7/2013 | Rankin | A45C 5/14<br>190/18 A |
| 2014/0224390 | A1* | 8/2014 | Nikakhtar | A45C 5/02<br>150/111 |
| 2015/0164194 | A1* | 6/2015 | Kiesling | A45C 5/005<br>132/315 |

* cited by examiner

CARRIER

CROSS-REFERENCE TO RELATED APPLICATIONS

This non-provisional application claims benefit and priority under 35 U.S.C. § 119(e) of U.S. provisional patent application Ser. No. 62/635,488, filed on Feb. 26, 2018 and titled "CARRIER," the contents of which are incorporated by reference for all purposes.

TECHNICAL FIELD

The field of the invention is that of article carriers.

BACKGROUND ART

Carriers have been designed with convenient features for organizing articles such as clothing, toiletries, electronics, office supplies, files, and the like. For example, carriers may be provided with means such as pockets, pouches, compartments, and the like for containing these articles.

Preferably such carriers will securely contain the articles while allowing the user to easily access the articles. Easy access to the means for containing the articles is desirable in order to reduce the time needed to locate and access the articles.

Carriers usually may not be altered after they are made. A user may have to acquire more than one carrier in order to accommodate the articles chosen by the user.

SUMMARY OF INVENTION

The invention provides a carrier having a case that may be opened to reveal an inner compartment. Sleeves adapted for containing articles are rotatably mounted to the case inside the compartment and may be accessed when the case is opened. The sleeves are called "pages" from their similarity to pages in a book and may be provided in a variety of sizes and with various pockets, pouches, compartments, straps, and other devices in order to hold articles. The pages may be permanently attached to the case or may be detachable. Detachable pages permit exchanging pages between cases of the same or different sizes and also selection of pages according to the articles the pages are to hold.

In an exemplary embodiment a carrier has a case comprising a front wall, a back wall, a top wall, a bottom wall, a right sidewall, and a left sidewall defining a compartment, a continuous opening defined in the top wall, the bottom wall, and one of the right and left sidewalls whereby the case may open into first and second sides having first and second sub-compartments when rotating about the other of the right and left sidewalls, a first page rotatably connected to the other of the right and left sidewalls and adapted to be contained in the first sub-compartment, a second page rotatably connected to the other of the right and left sidewalls and adapted to be contained in the first sub-compartment between the first page and one of the front wall and the back wall, and at least one of the first and second pages are adapted to hold articles. Additional pages may be provided for the first as well as the second sub-compartment, and zipper or other device used to close the continuous opening. The articles that may be held or carried by the pages can be electronic devices such as laptop computers, tablet computers, smartphones, and the like and their associated paraphernalia, such a cables and batteries, or stationary products such as pads of paper and writing devices such as pens, or keys, or clothing, or personal care products, or whatever a traveler may need to carry with him or her.

In another exemplary embodiment, a carrier has a case comprising a front wall, a back wall, a top wall, a bottom wall, a right sidewall, and a left sidewall defining a compartment, a continuous opening defined in the top wall, the bottom wall, and one of the right and left sidewalls whereby the case may open into first and second sides having first and second sub-compartments when rotating about the other of the right and left sidewalls, a first zipper attached to the top wall, the bottom wall, and one of the right and left sidewalls, wherein the first zipper is adapted for closing the opening, a first page rotatably connected to the other of the right and left sidewalls and adapted to be contained in the first sub-compartment, a second zipper attached to the first page and the top wall, the bottom wall, and the one of the right and left sidewalls, wherein the second zipper is adapted to releaseably connect the first page to the top wall, the bottom wall, and the one of the right and left sidewalls on a first side of the continuous opening and cover the first sub-compartment, a second page rotatably connected to the other of the right and left sidewalls and adapted to be contained in the first sub-compartment between the first page and one of the front wall and the back wall, and at least one of the first and second pages are adapted to hold articles. Other devices, such as clasps and latches, may be provided instead of a first zipper to secure the continuous opening in the case. Pages may be provided for the second sub-compartment. The second zipper could be replaced with a strap with a buckle to secure the first page at the first side of the continuous opening. The pages may be detachable from the case in order to permit using pages with different sizes and different compartments and pouches or other devices for holding articles according to what the user wishes to carry.

In a further exemplary embodiment a kit for providing a carrier for articles has a case comprising a front wall, a back wall, a top wall, a bottom wall, a right sidewall, and a left sidewall defining a compartment, a continuous opening defined in the top wall, the bottom wall, and one of the right and left sidewalls whereby the case may open into first and second sides having first and second sub-compartments when rotating about the other of the right and left sidewalls, a first page having an edge provided with one of a loop or a clip for detachable connection to one of a clip or loop provided on the other of the right and left sidewalls, wherein the first page is adapted to rotate about the other of the right and left sidewalls, wherein the first page is adapted to be contained in the first sub-compartment and the first page is also adapted to contain articles. Additional pages could be provided to fit into the first sub-compartment and into the second sub-compartment, as desired. Pages may be provided with different sizes and different compartments and pouches or other devices for holding articles according to what the user wishes to carry. The pages could be sized and shaped to be inserted into cases of different sizes. The clips and loops could be replaced with other devices for detachable connection of the pages to the case, such as rails and grooves.

BRIEF DESCRIPTION OF DRAWINGS

Other objects, features, and advantages of the present invention will become more fully apparent from the following detailed description of preferred embodiments, the appended claims, and the accompanying drawings in which:

1 is a perspective view of the front side of a first embodiment of a carrier according to the present invention.

DESCRIPTION OF EMBODIMENTS

Figure 1:
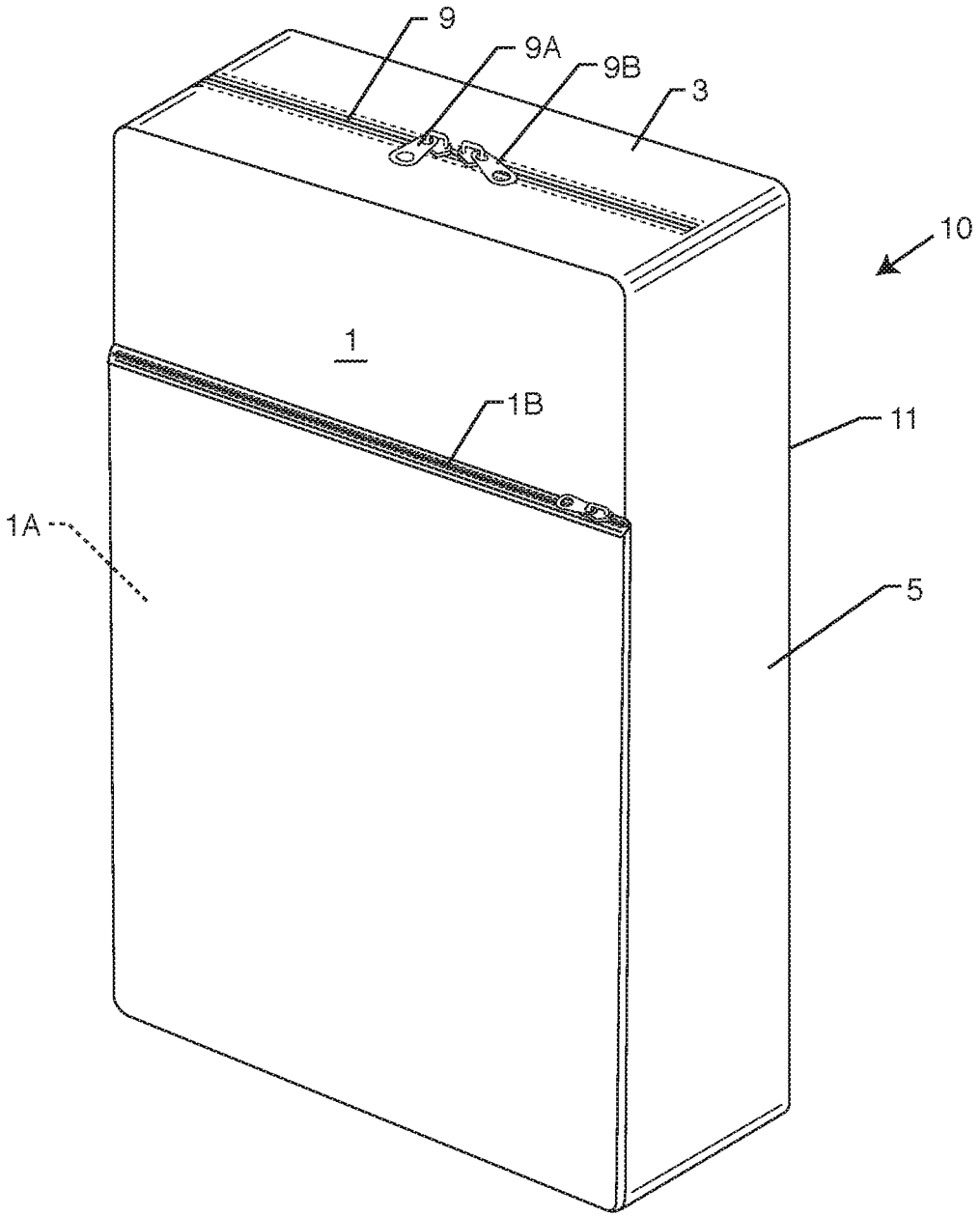

This specification discloses three embodiments of a carrier according to the invention. Referring now to FIGS. 1-5 in the drawings, a preferred embodiment of a carrier 10 according to the invention is shown. The carrier 10 as shown in the drawings has a case 11 comprising three pairs of generally parallel walls joined to each other in the shape of a rectangular parallelepiped, namely a front wall 1 opposed to a back wall 2, a top wall 3 opposed to a bottom wall 4, and a right wall 5 opposed to a left wall 6.

The walls 1-6 define a compartment 7 that is accessed by an opening 8 defined in the top wall 3, the right wall 5, and the bottom wall 4. The zipper 9 secures the opening 8 and is opened by zipper slider and pulls 9A and 9B. It will be understood that the opening 8 could be defined in other walls, such as the top wall 3, the left sidewall 6, and the bottom wall 4, as long as the opening 8 permits access to the compartment 7, and that only one zipper slider and pull could be provided although two are convenient.

The walls 1-6 of the case 11 of the carrier 10 may be made of fabric and the fabric may be reinforced with foam sheets (not shown in the drawings) and/or polyethylene (PE) boards (not shown in the drawings) for protection of the contents of the compartment 7 and/or shape retention. The foam sheets and/or PE boards preferably are sandwiched between parallel layers of fabric. The fabric of each of the sides 1-6 may be contiguous with adjacent sides or sewn to each other as desired. Persons of skill in the art of carriers will understand that different materials and modes of construction may be employed to construct the case 11.

Alternatively, the walls 1-6 of the case 11 could be made of a metal alloy or plastic. These more rigid materials may require an alternative closure device, such as latches. In addition, the case 11 could have a different shape than that of a rectangular parallelepiped. For example, two of the opposed walls could be semicircular in outline, as in certain cases for bows. In the case of a case for bows the "pages" to be described below could support or hold arrows and archery tools and gear.

FIG. 1 shows the front wall 1 of the case 11 of the carrier 10. The front wall 1 is provided with a pocket 1A (not directly shown in the drawings) accessed by the zipper 1B. The pocket 1A is an optional feature.

Figure 2:
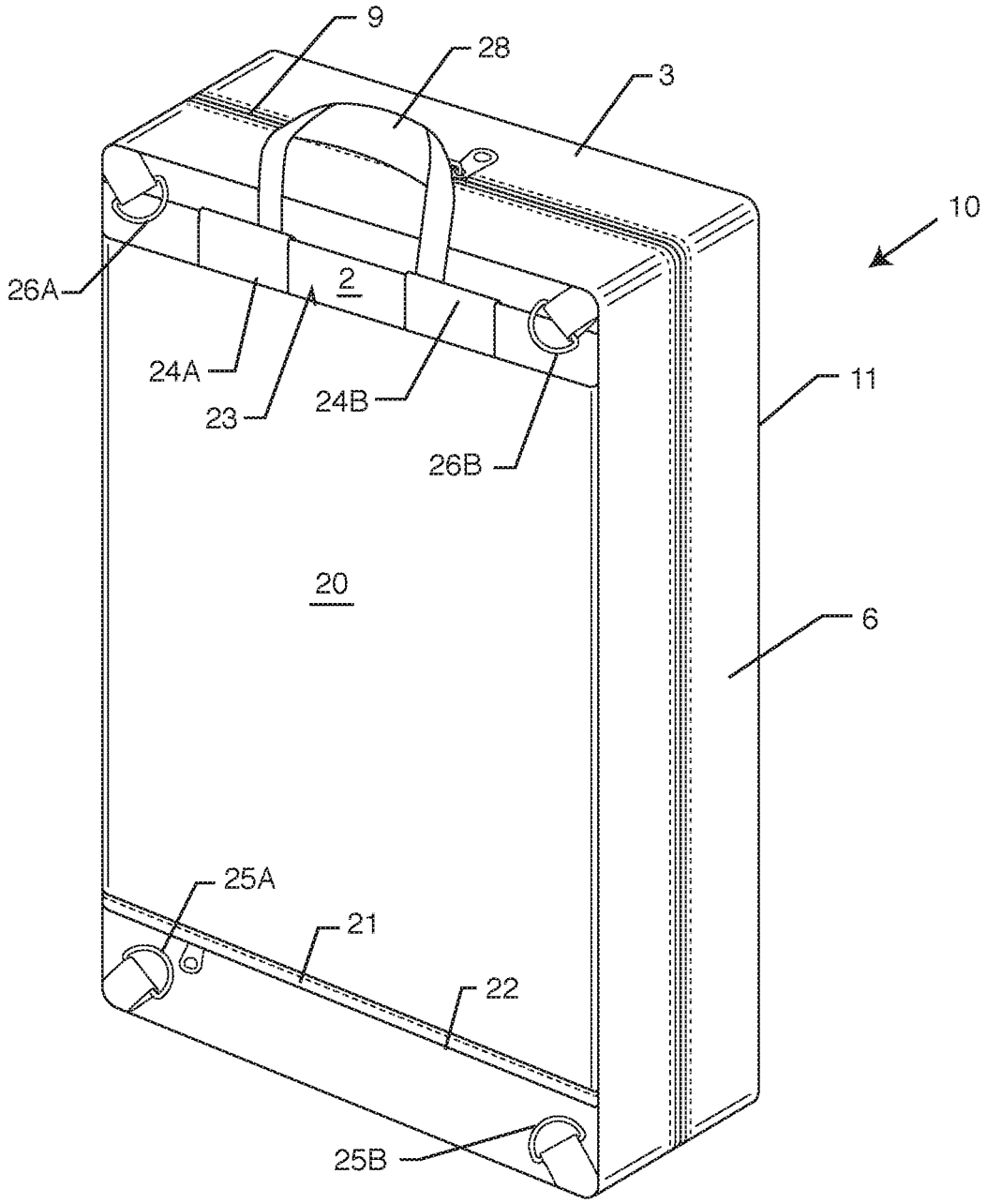
FIG. 2 is a perspective view of the back side of the carrier of FIG. 1.

FIG. 2 shows the back wall 2 of the case 11 of the carrier 10. A sheet 20 is attached to the right and left sides of the back wall 2. A zipper 22 secures an opening 21 defined between the bottom of the sheet 20 and the back wall 2. The top edge 23 of the sheet 20 is not secured to the back wall 2. The shoulder straps 24A and 24B are attached to the back wall 2 above the sheet 20. The lower ends of the shoulder straps 24A and 24B (not shown) are disposed behind the sheet 20 but may be pulled out from under the sheet 20 and attached to the spaced D-rings 25A and 25B at the lower end of the back wall 2 by means of snap hooks (not shown) in order for a user of the carrier 10 to bear the carrier 10 as a backpack by passing the shoulder straps 24A and 24B over the user's shoulders.

The D-rings 26A and 26D are provided at the upper end of the back wall 2 for attachment to a separate carrying strap (not shown in the drawings) by snap hooks attached to that carrying strap. The user will have the option of attaching the carrying strap between any combination of the D-rings 25A, 25B, 26A, and 26B, as desired.

The outer side of the case 11 of the carrier 10 may have handles disposed as convenient or needed, such as on the back wall 2 or the top wall 3. A handle 28 attached to the back wall 2 is shown in FIG. 2.

Figure 3:
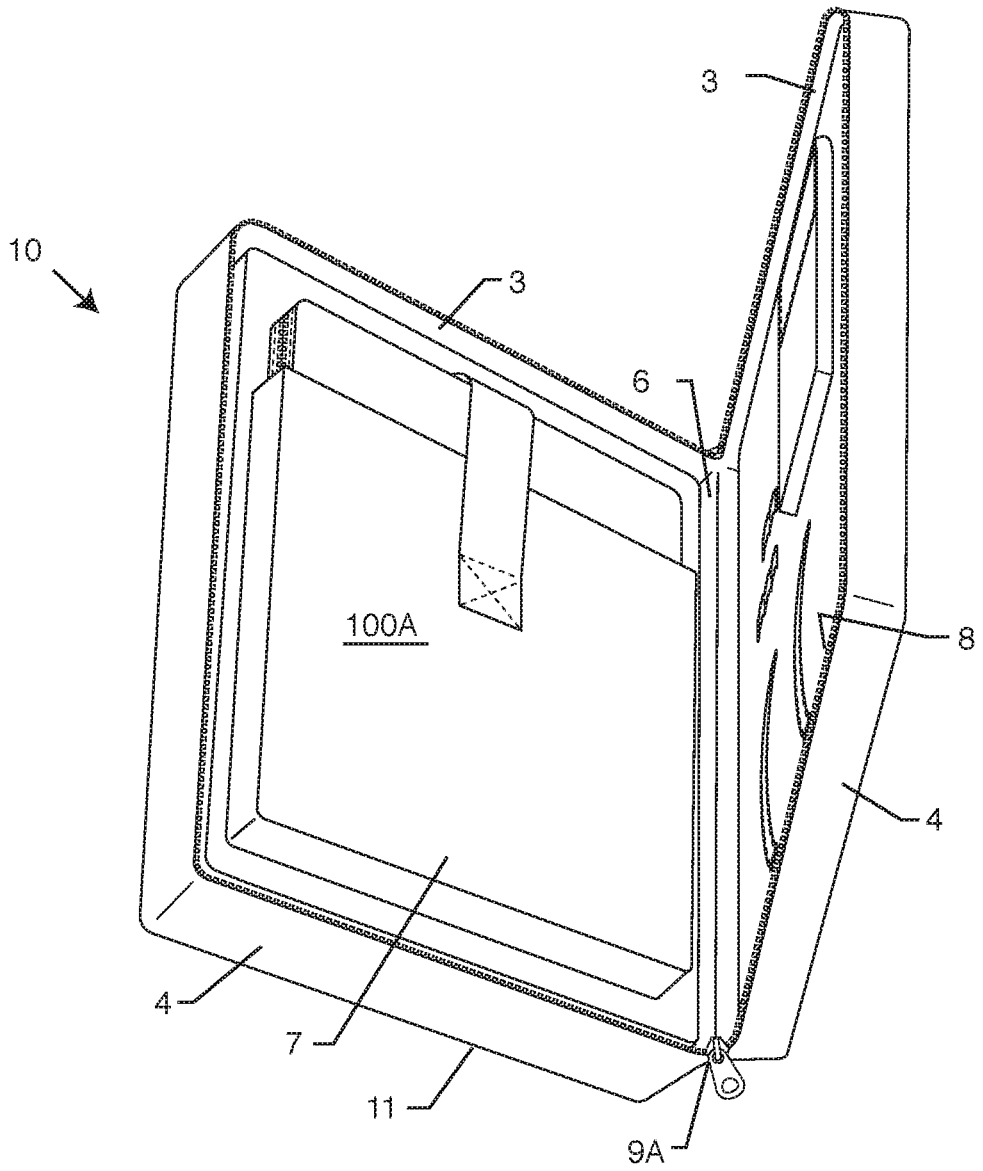
FIG. 3 is a perspective view of the carrier of FIG. 1 in a partly open configuration.

FIG. 3 shows how the case 11 of the carrier 10 is opened. The user slides the zipper sliders 9A and 9B apart along the zipper 9 so the opening 8 is no longer closed. The front wall 1 of the case 11 will rotate away from the back wall 2 and expose the compartment 7. The left sidewall 6 will serve as the hinge between the front wall 1 and the back wall 2. Alternatively, the hinge could be a hinge formed of metal or plastic and attached to the left sidewall 6.

Figure 4:
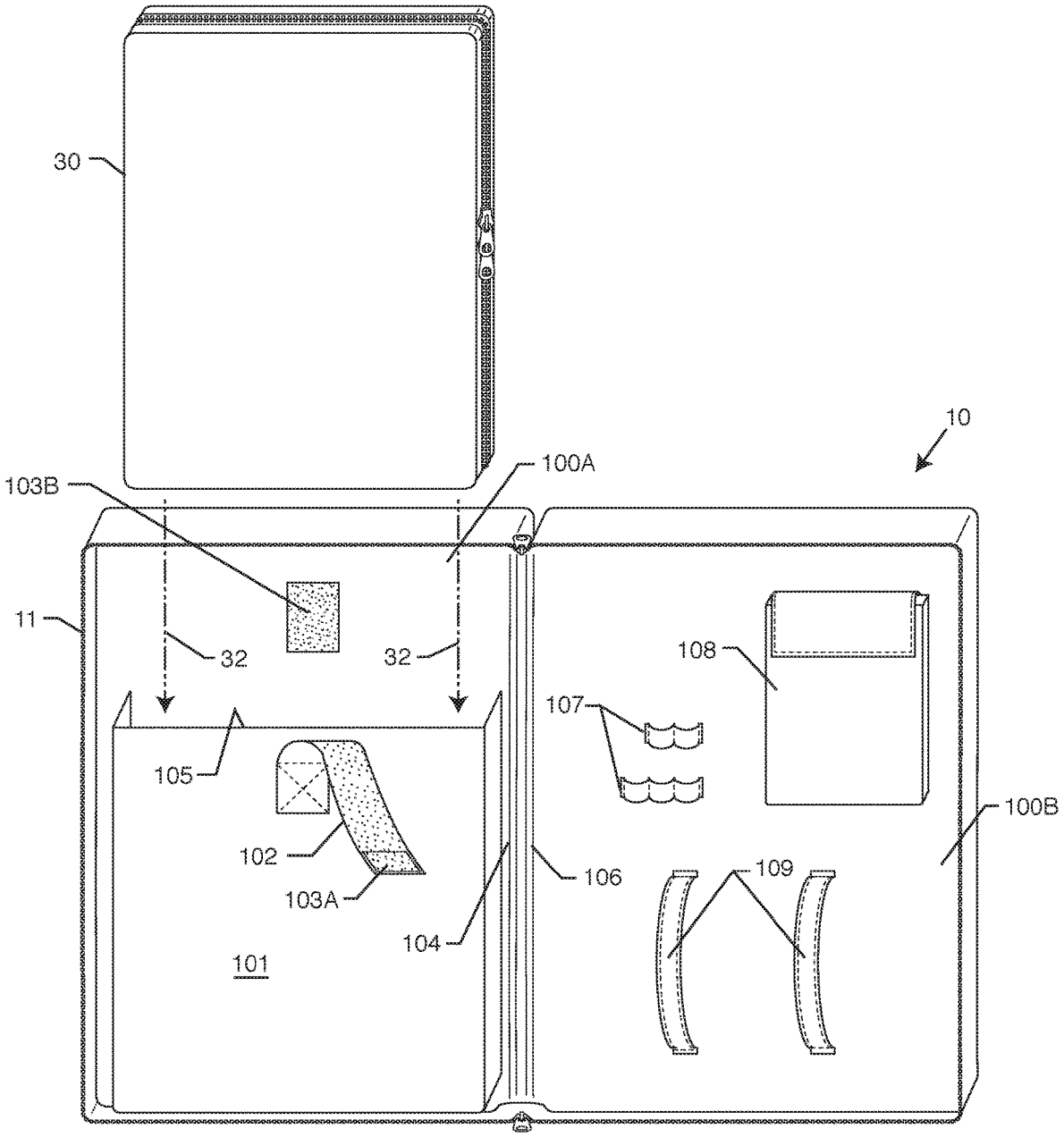
FIG. 4 is a perspective view of the carrier of FIG. 1 in a fully open configuration.

FIG. 4 shows the case 11 of the carrier 10 in a fully open configuration with the left sidewall 6 serving as a hinge. The case 11 may be placed on a level surface such as a bed or table to more easily access the contents.

FIG. 3 begins to show, and FIG. 4 fully shows, two of the "pages" that were contained in the compartment 7. A "page" has pouches, pockets, straps and the like and is adapted to contain or carry items as further explained below. A "page" in this embodiment of the invention, namely the carrier 10, is generally rectangular in outline and is attached to the left sidewall 6 of the case 11 in such a way that the "page" may rotate about that attachment. The "page" is sized to fit within the compartment 7. "Pages" permit the user to organize his or her articles as described below in more detail. This specification henceforth will refer to "pages" without the quote marks and will use the reference number 100 for pages. The reference number 100, by itself, will refer to any page. A capital letter will be added to the reference number 100 in order to distinguish among different types of pages, thus: 100A, 100B, etc.

Figure 5:
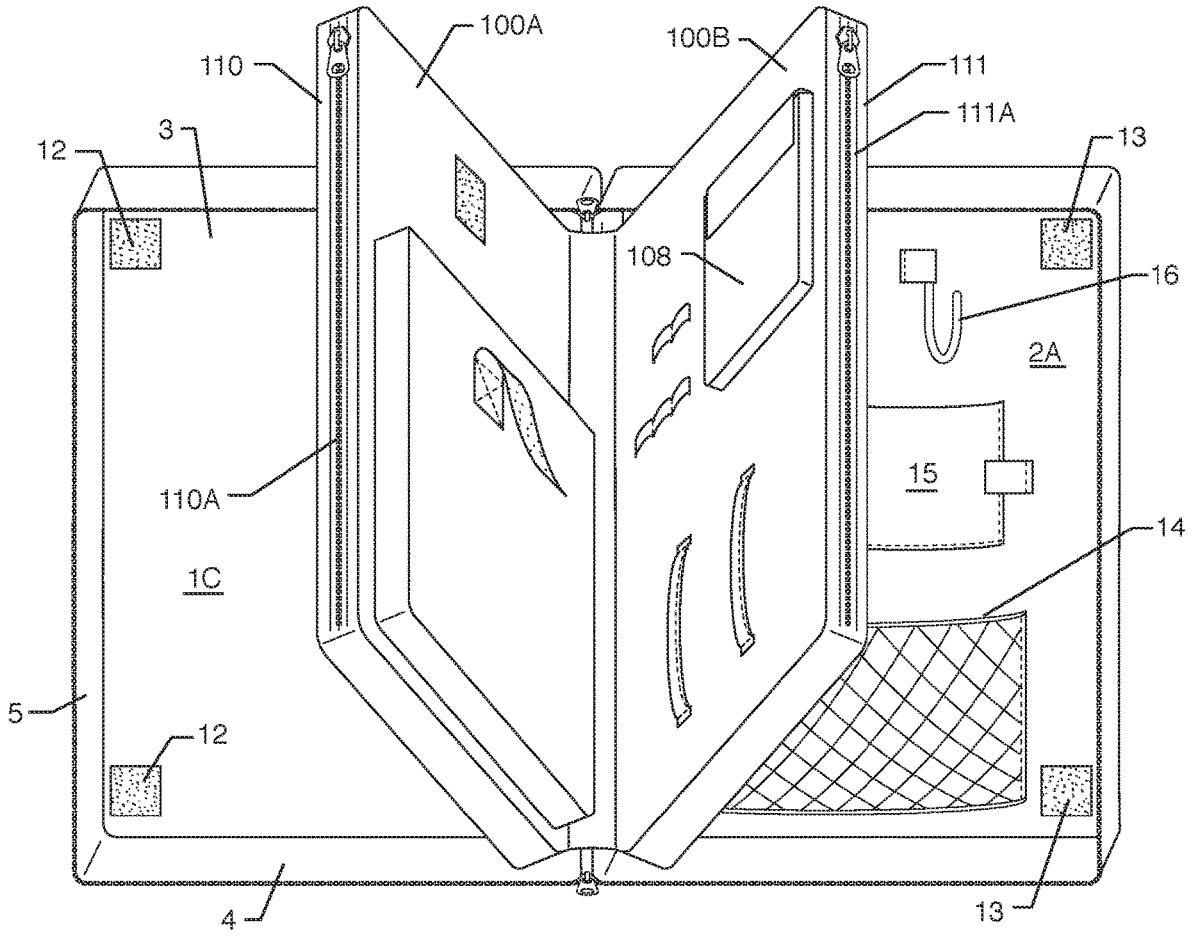
FIG. 5 is a perspective view of the carrier of FIG. 1 in a fully open configuration with two "pages" rotated toward each other.

The pages 100 come in different configurations as needed to contain various articles. For example, the page 100A is visible in FIGS. 3-5. The page 100A is sized and shaped to fit into the compartment 7 when the zipper 9 closes the case 11. The page 100A is attached along its edge 104 to the left sidewall 6 but is otherwise not attached to the case 11 (other than by hook and loop patches as described below). The page 100A therefore may rotate about its juncture with the left sidewall 6 at the edge 104 in the fashion of a page in a book. As shown in FIGS. 3-5, the page 100A has a rectangular outline, like the page in a book, and will extend in height and width to fit the compartment 7.

The page 100A preferably is made of fabric sewn around one or more sheets of foam or other stiffening material such as PE board. The stiffening material will provide some rigidity to the page 100A so that it will retain its shape. The page 100A, and the other pages described below, may be made of other materials such as plastics of various kinds.

The page 100A has a pocket 101 on one side adapted to receive a laptop computer. The pocket 101 is open at its top 105 and is secured by a webbing strap 102 sewn to the pocket 101. The webbing strap 102 may be secured to the page 100A by the mating hook and loop fabric patches 103A and 103B in order to secure the laptop computer in the pocket 101. Preferably, the page 100A will have a sheet of foam padding or other reinforcing sheet material to both stiffen the page 100A and protect the laptop computer from impact.

FIG. 4 shows a laptop computer encased in a protective laptop computer sleeve 30 and the phantom lines 32 show how the laptop computer and sleeve 30 may be inserted into the pocket 101. A laptop computer may of course be inserted and carried in the pocket 101 without a sleeve. Alternatively, a tablet computer (with or without a protective laptop sleeve) may be inserted into the pocket 101.

Referring to FIGS. 4 and 5, the page 100B is located on the other side of the outer case 11 from the page 100A. The page 100B also has a rectangular outline and is attached to the left sidewall 6 at the edge 106 of the page 100B but is not otherwise attached to the outer case 11. The page 100B may rotate about its connection to the left sidewall 6 in the manner of the page of a book. The page 100B has a rectangular outline sized to fit within the compartment 7. The page 100B preferably is made of fabric sewn around a sheet of foam or other stiffening material such as PE board. The stiffening material will provide some rigidity to the page 100B so that it will retain its shape.

As shown in FIGS. 3-5, the side of the page 100B visible in those drawings contains various devices attached to the page 100B to hold articles onto the page 100B. Two sets of loops 107 attached to the page 100B, such as by sewing, will serve as penholders. A pocket 108 is attached, such as by sewing or welding, to the page 100B for containing objects such as credit cards, a passport, and the like. The pocket 108 may be made of material that will defeat remote reading of the credit cards or passport by radio frequency identification ("RFID skimming") techniques and thus may be considered a "RFID wallet." Two straps 109 are attached, such as by sewing, to the page 100B for holding cables such as charger and USB cables to the surface of the page 100B. Those of skill in the art will understand that other devices may be attached to the page 100B for containing or holder useful articles.

FIG. 5 shows the inner side 1C of the front wall 1 of the outer case 11. The inner side 1C of the front wall 1 has hook or loop patches 12 attached to the inner side 1C of the front wall 1 at the corner adjoining the bottom wall 4 and the right sidewall 5 and at the corner adjoining the top wall 3 and the right sidewall 5, respectively. The hook or loop patches 12 will mate with loop or hook patches attached to corresponding corners of the page 100A (not shown). These mating hook or loop patches will secure the page 100A to the inner side 1C of the front wall 1 in normal use. Separation of the mating hook or loop patches, such as by hand, will permit the page 100A to be rotated away from the inner side 1C of the front wall 1 as needed.

As shown in FIG. 5 the inner side 2A of the back wall 2 is provided with hook or loop patches that will mate with loop or hook patches attached to corresponding corners of the page 100B (not shown). These mating hook or loop squares will secure the page 100B to the inner side 2A of the back wall 2 in normal use. Separation of the mating hook or loop patches, such as by hand, will permit the page 100B to be rotated away from the inner side 2A of the back wall 2 as needed.

Rotation of the page 100B away from the inner side 2A of the back wall 2 permits access various devices attached to the inner side 2A of the back wall 2. These devices will hold items of use to the user. As shown in FIG. 5, these devices include a netting pocket 14, a battery pocket 15, and a key holder 16.

FIG. 5 shows the pages 100A and 100B to be rotated away from the inner side 1C of the front wall 1 and the inner side 2A of the back wall 2, respectively. As shown in FIG. 5, each of the pages 100A and 100B has a free edge, 110 and 111, respectively, opposed to the edge attached to the left sidewall 6, namely edges 104 and 106, respectively. The free edges 110 and 111 have openings secured by the zippers 110A and 111A, respectively, for accessing compartments formed inside each of the pages 100A and 100B. (The compartments are not shown in the drawings.) The compartments preferably span the height and width of the pages 100A and 100*b*, respectively. The user may store articles in these pockets such as writing pads, files, clothing such as jeans or lingerie, and the like.

Figure 6:
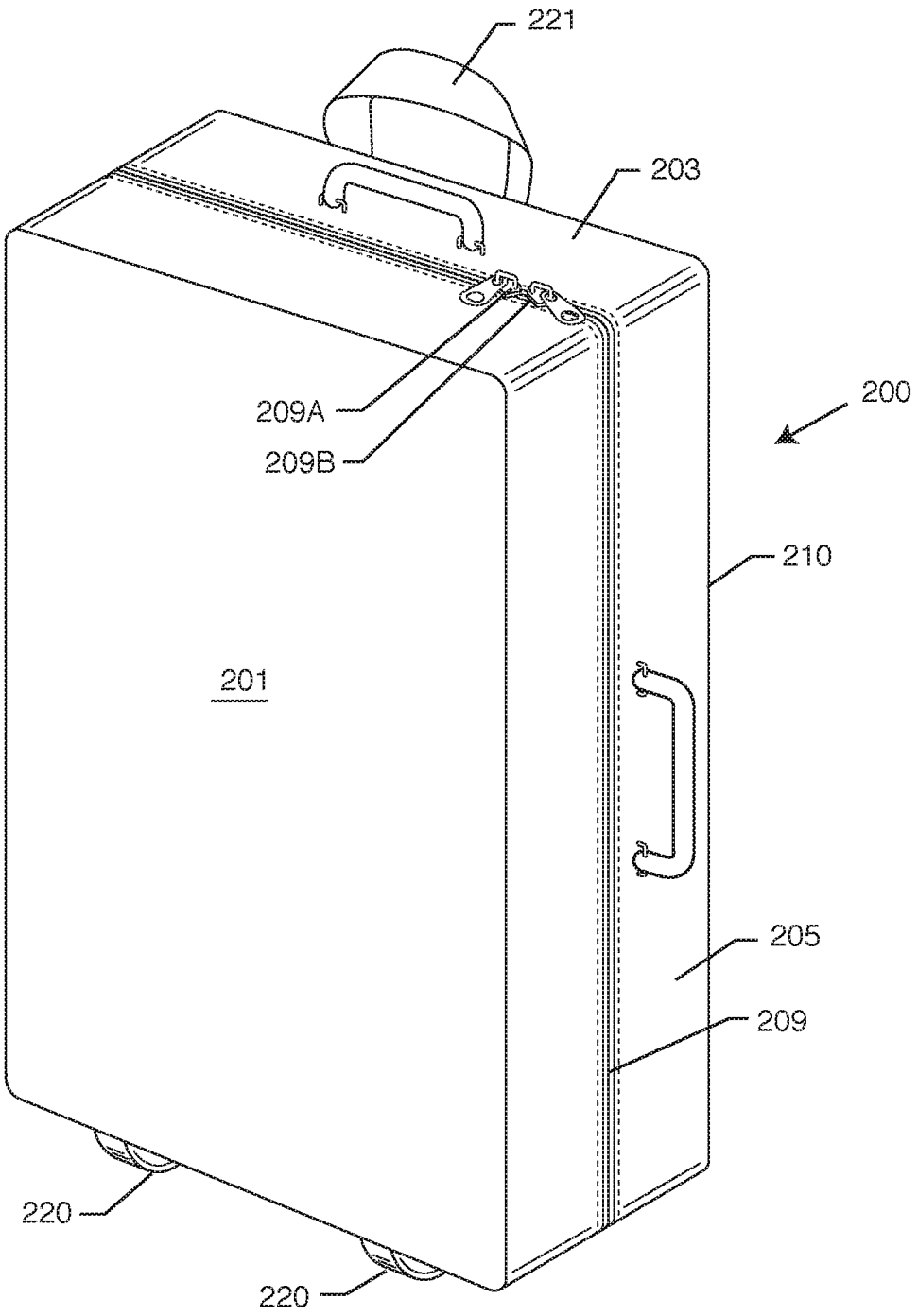
FIG. 6 is a perspective view of the front side of a second embodiment of a carrier according to the present invention.

FIGS. 6-12 show a second embodiment 200 of the carrier according to the invention. The carrier 200 has a case 210 and preferably is sized to serve as a large carrier such as a piece of rolling luggage. As shown in FIG. 6, the case 210 may be supplied with wheels 220 and a handle 221 (shown schematically) to make the carrier 200 a roller. Persons of skill in the art will understand that providing wheels 220 and a handle 221 to a carrier will require a frame and handle assembly attached to or inside the case 210. The technology for doing so is well understood and need not be discussed in greater detail.

The case 210 of the carrier 200 as shown in the drawings comprises three pairs of generally parallel walls joined in the shape of a rectangular parallelepiped, namely a front wall 201 opposed to a back wall 202, a top wall 203 opposed to a bottom wall 204, and a right wall 205 opposed to a left wall 206. The walls 201-206 define a compartment 207 that is accessed by an opening 208 defined in the top wall 203, the right wall 205, and the bottom wall 204. The zipper 209 secures the opening 208 and is opened by zipper pulls 209A and 209B. It will be understood that the opening 208 could be defined in other walls, such as the top wall 203, the left sidewall 206, and the bottom wall 204, as long as the opening 208 permits access to the compartment 207.

FIGS. 7-12 show the case 210 when the zipper 209 is unzipped to expose the opening 208. The case 210 separates into the two sides 212 and 213 that are rotated away from each other along the hinge 214 joining the two sides 212 and 213. The hinge 214 is part of the left sidewall 206 as shown in the drawings. Alternatively, the hinge 214 could be a hinge formed of metal or plastic and attached to the left sidewall 206.

As shown in FIGS. 7-12, the sides 212 and 213 of the case 210 define the sub-compartments 207A and 207B. The sub-compartments 207A and 207B are portions of the compartment 207 that is defined when the case 210 is closed. The sub-compartments 207A and 207B normally would be open to access when the case 210 is opened unless the openings 208A and 208B of the sub-compartments 207A and 207B were closed by the pages 100C and 100D.

The pages 100C and 100D are like the pages 100A and 100B described above in connection with the carrier 1: they are rectangular in outline and are connected to the left sidewall 206 at their edges 112 and 113, respectively, so they can hinge about their connections to the left sidewall 206. The pages 100C and 100D have three sides not connected to the left sidewall 206.

The page 100C has three sides that are reversibly connectible to the top wall 203, the right sidewall 205, and the bottom wall 204 by means of the zipper 211A. The page 100D has three sides that are reversibly connectible to the top wall 203, the right sidewall 205, and the bottom wall 204 by means of the zipper 211B. The page 100C therefore may secure the opening 208A to the sub-compartment 207A and the page 100D may secure the opening 208B to the sub-compartment 207B. Unzipping the zippers 211A and 211B will expose the openings 208A and 208B, respectively, and provide access to the sub-compartments 207A and 207B, respectively.

Figure 7:
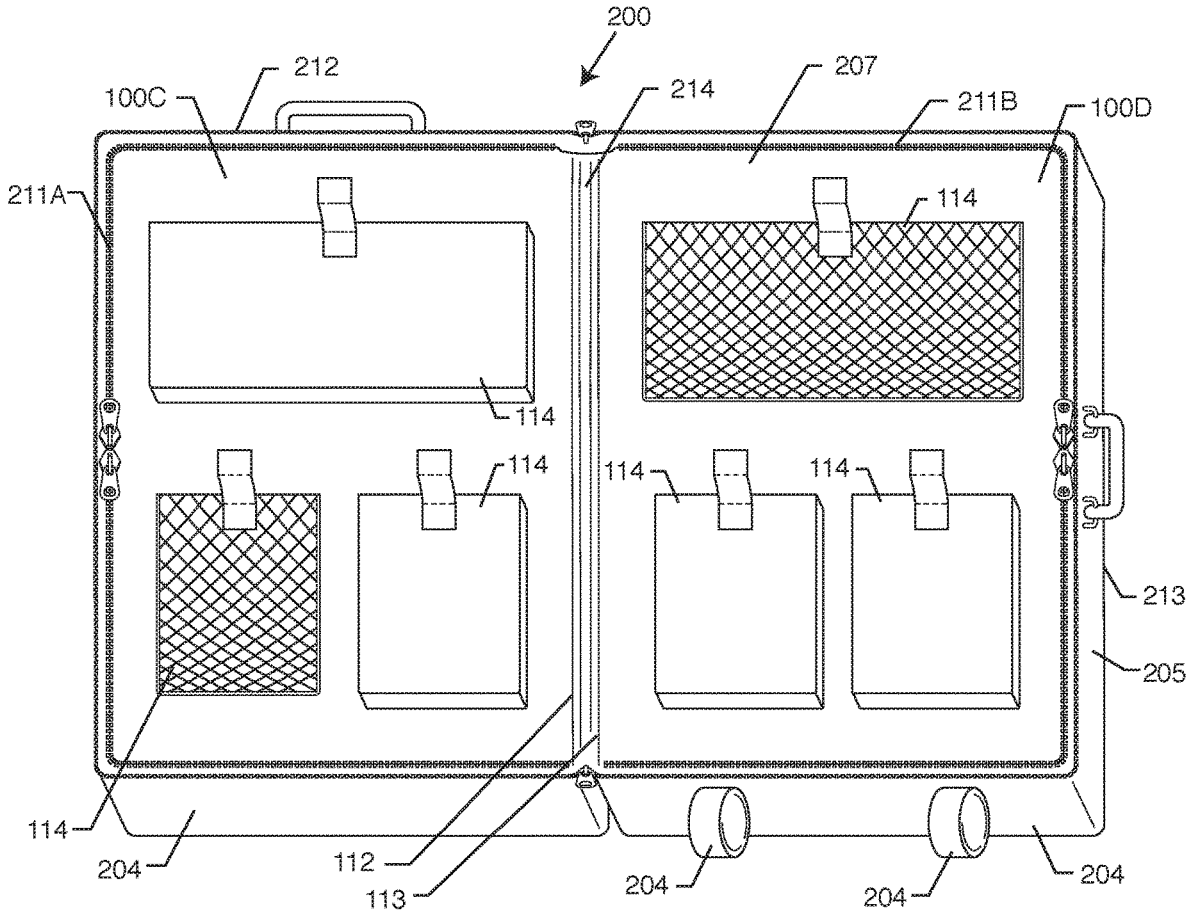
FIG. 7 is a perspective view of the carrier of FIG. 6 in a fully open configuration.

The pages 100C and 100D may have pockets and the like of the same or different sizes and types attached to their upper sides (the sides visible upon opening the case 210) for receiving and containing various articles, as is best seen in FIG. 7. The reference number 114 generically identifies these pockets and the like in FIG. 7. The pages 100C and 100D may have additional pockets and storage devices 114 on their other sides for receiving and storing various articles as may be seen in FIGS. 9 and 10.

Figure 8:
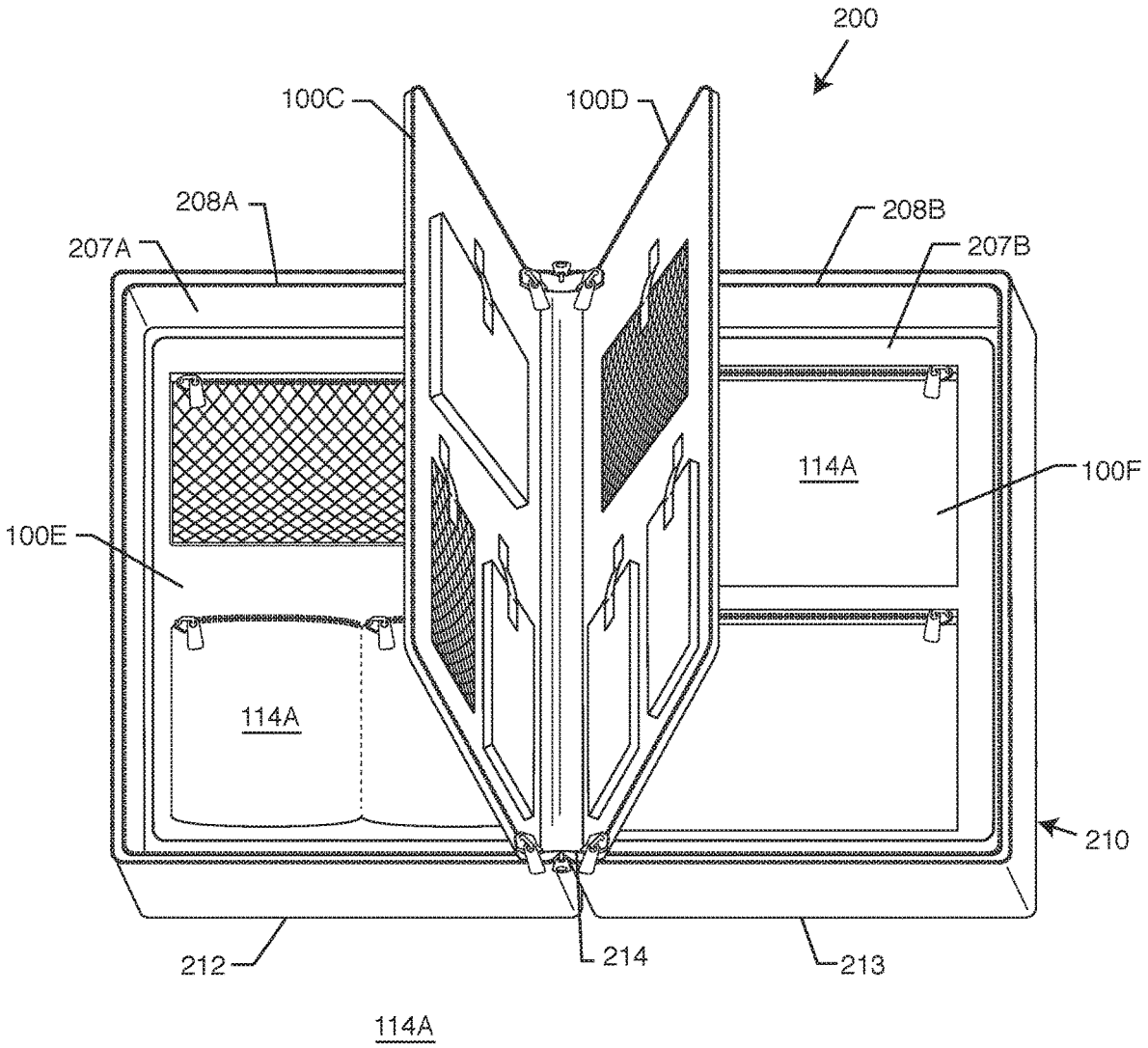
FIG. 8 is a perspective view of the carrier of FIG. 6 in the fully open configuration with two "locking pages" unzipped from opposing sides of the carrier and rotated toward each other.
Figure 9:
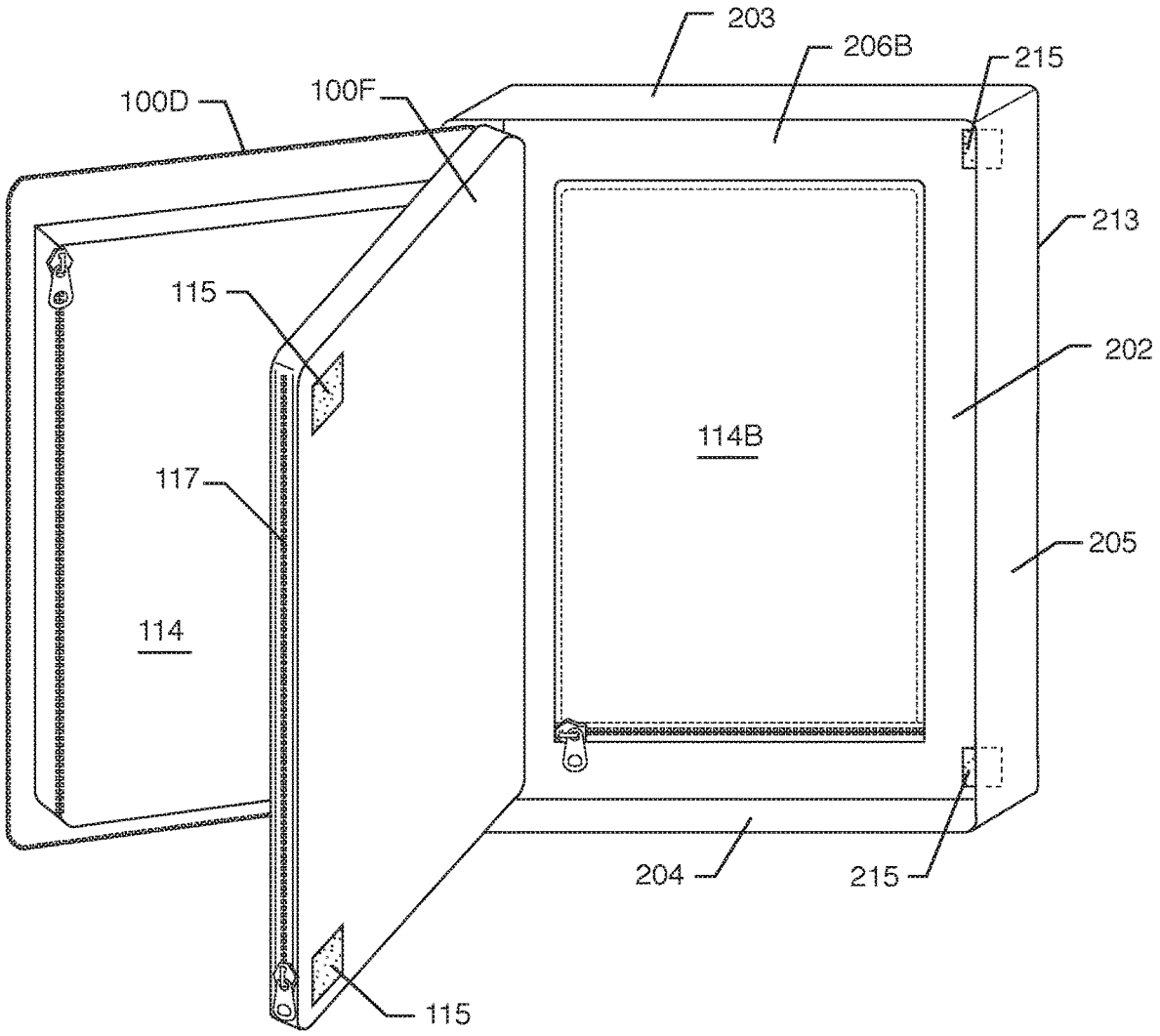
FIG. 9 is a perspective view of the right side of the carrier of FIG. 6 when that carrier is in the fully open configuration and showing the "locking page" and another "page" partially rotated away from the right side of the carrier of FIG. 6.
Figure 10:
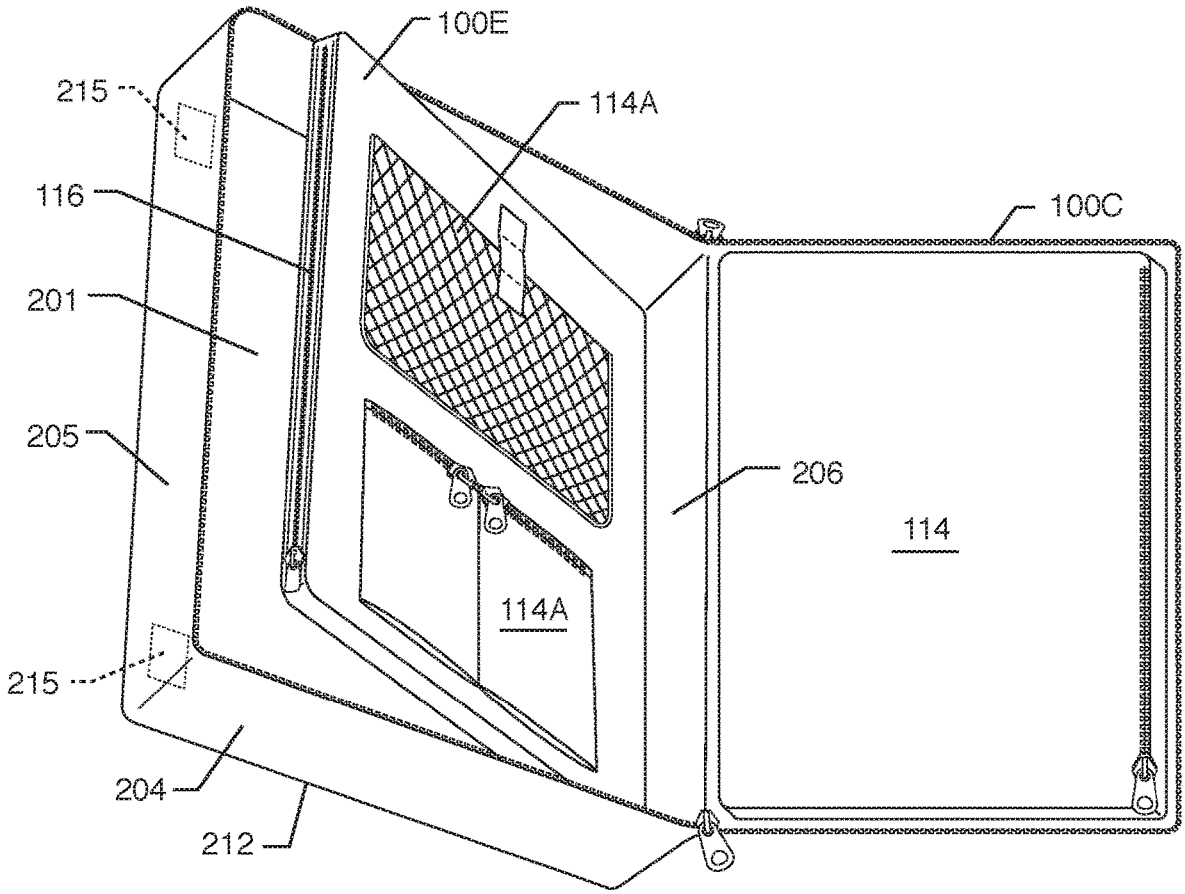
FIG. 10 is a perspective view of the left side of the carrier of FIG. 6 when that carrier is in the fully open configuration and showing the "locking page" rotated away from the left side of the carrier of FIG. 6 and the other "page" partially rotated away from the left side of the carrier of FIG. 6.

FIG. 8 shows the additional pages 100E and 100F. The page 100E is attached to the front wall 201 near the bottom of the sub-compartment 207A in the first side 212 of the carrier 200 and the page 100F is attached to the rear wall 202 near the bottom of the sub-compartment 207B in the second side 213 of the carrier 200. FIG. 9 shows the page 100F rotated away from the back wall 202. FIG. 10 shows the page 100E rotated away from the front wall 201. The pages 100E and 100F may have pockets and the like of the same or different sizes and types attached to their upper sides. The reference number 114A generically identifies these pockets and the like in FIGS. 8, 10, and 12.

Figure 11:
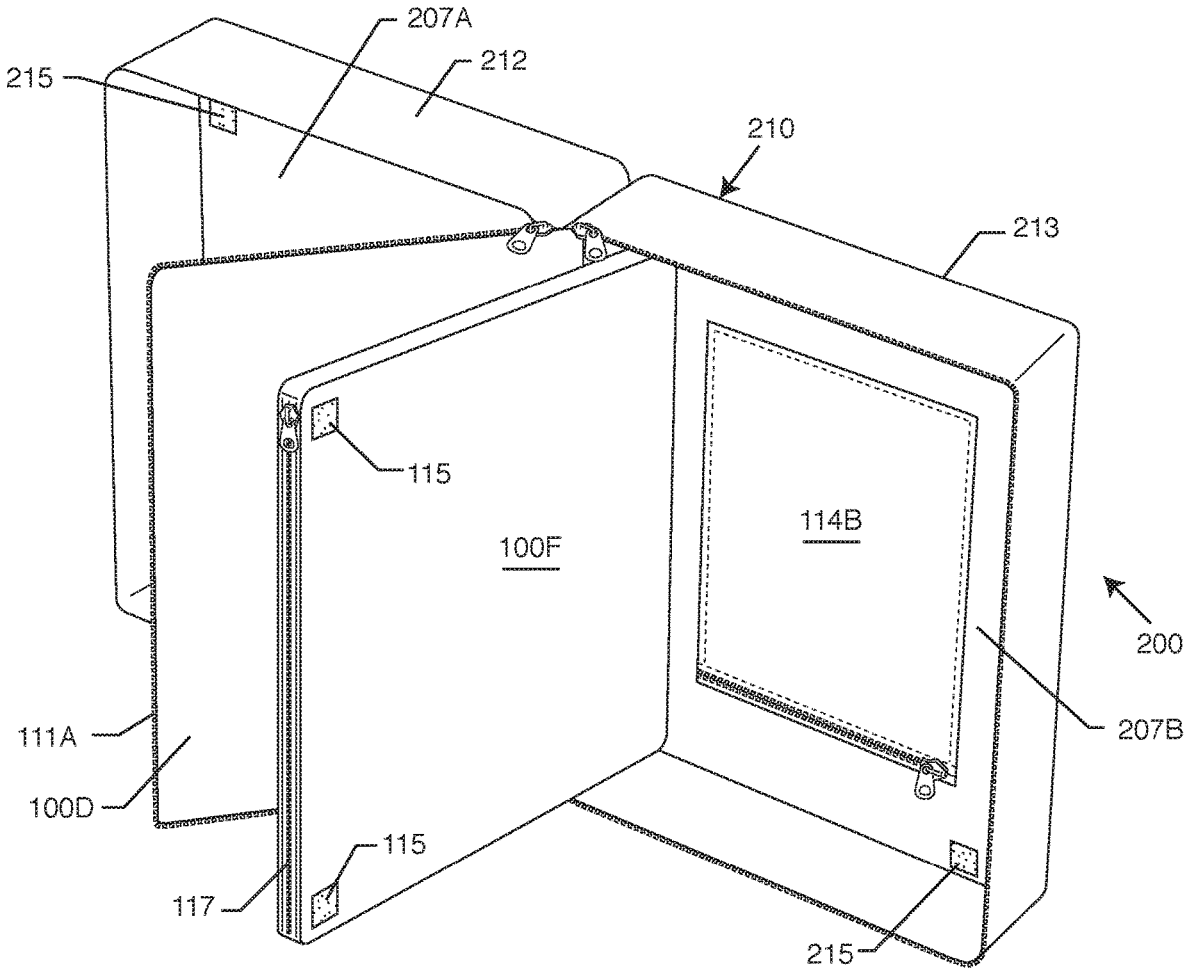
FIG. 11 is a perspective view of the carrier of FIG. 6 when that carrier is in the fully open configuration and showing the "locking page" and the other "page" rotated away from the right side of the carrier of FIG. 6.
Figure 12:
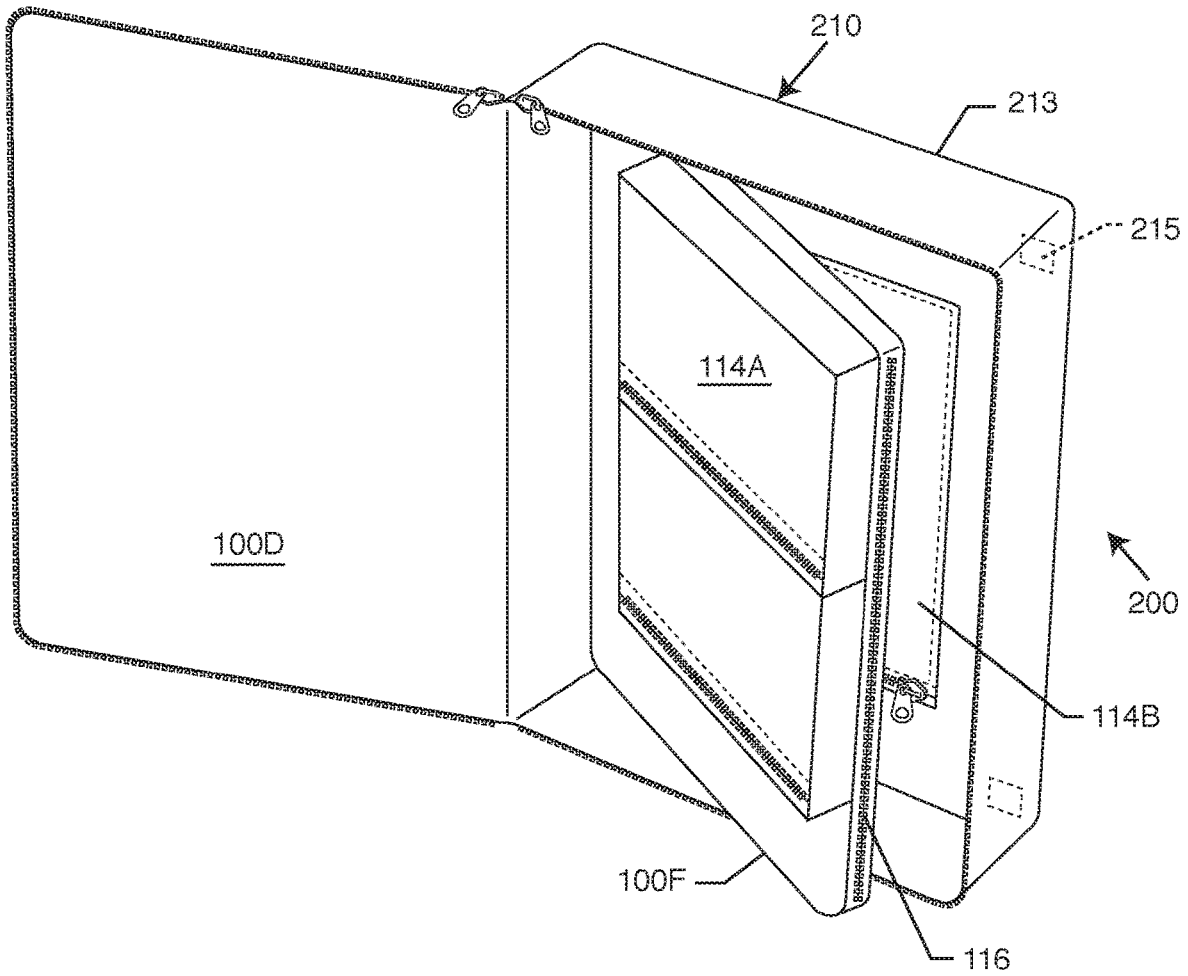
FIG. 12 is a perspective view of right side of the carrier of FIG. 6 and showing the "locking page" and a different other "page" rotated away from the right side of the carrier of FIG. 6.

The interior side of the back wall 202 is shown in FIGS. 9, 11, and 12 to have a pocket 114B attached to the back wall 202. Two or more such pockets or storage devices (or none) may be attached to the back wall 202. Although not shown in FIGS. 10 and 11, pockets or storage devices may be attached to the inside of the front wall 201.

Hook or loop patches 215 are attached, such as by sewing or welding, on the interiors of the front wall 201 and the back wall 202 to reversibly connect with loop or hook patches 115 on the pages 100E and 100F in order to secure those pages in the sub-compartments 207A and 207B, respectively.

The pages 100E and 100F preferably have compartments formed in them in the same way as described above for the pages 100A and 100B. The zippers 116 and 117, respectively, secure these compartments.

FIGS. 13-15, 17A-17D, 18, and 19 show a third embodiment 300 of the carrier according to the invention. The case 310 of the carrier 300 as shown in the drawings comprises three pairs of generally parallel planes joined in the shape of a rectangular parallelepiped, namely a front wall 301 opposed to a back wall 302, a top wall 303 opposed to a bottom wall 304, and a right wall 305 opposed to a left wall 306. The walls 301-306 define a compartment 307 that is accessed by an opening 308 defined in the top wall 303, the right wall 305, and the bottom wall 304. The zipper 309 secures the opening 308 and is opened by the zipper sliders and pulls 309A and 309B. It will be understood that the opening 308 could be defined in other walls, such as the top wall 303, the left sidewall 306, and the bottom wall 304, as long as the opening 308 permits access to the compartment 307.

In external appearance the case 310 of the carrier 300 is similar to the cases 10 and 210 of the carriers 1 and 200, respectively. It can be provided in different sizes ranging from a handbag to a rolling bag or roller. The case 310 may be provided with wheels or shoulder straps or both. The carrier 300 is notably different from those embodiments in that the pages are separable from the case 310. This feature permits the user to customize his or her choice of pages from a selection of pages that is varied in both size and function or storage capacity. The pages can be used in cases of different sizes.

Figure 13:
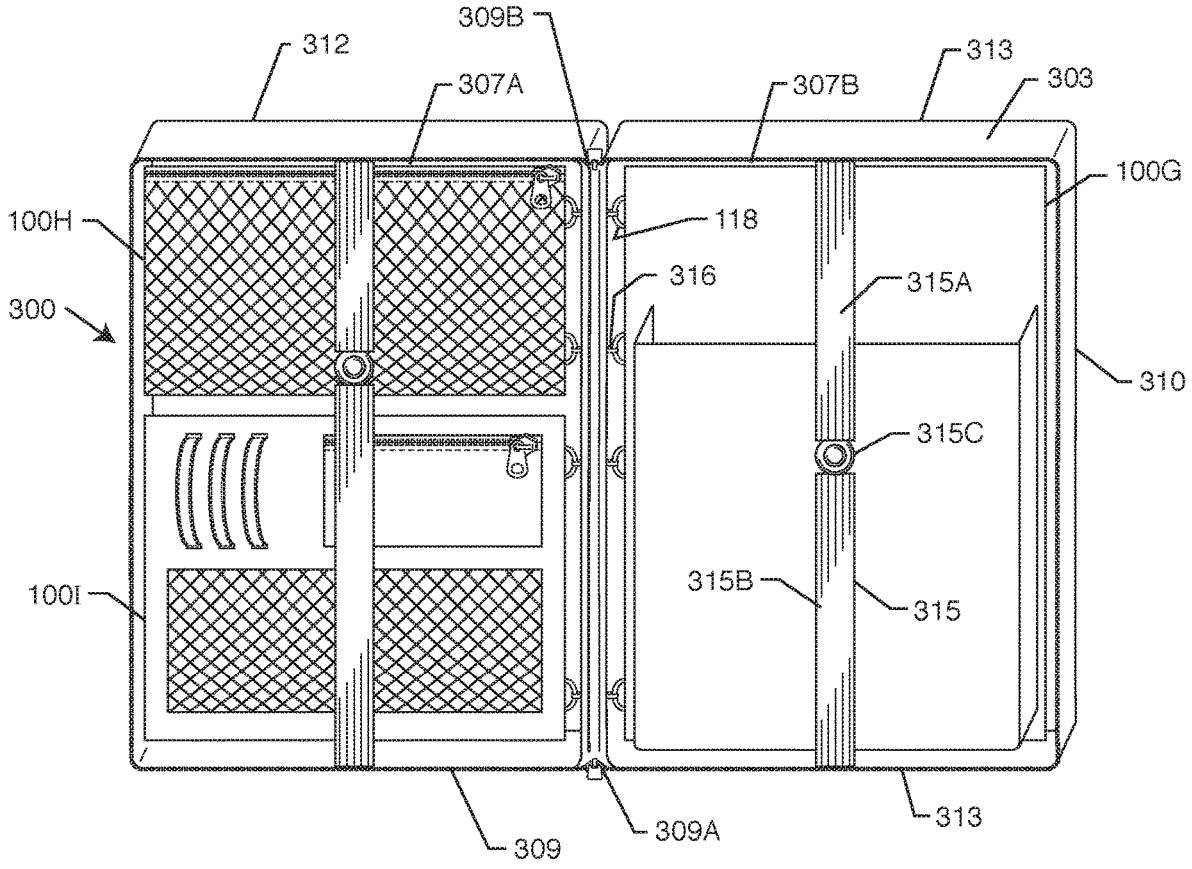
FIG. 13 is a perspective view of a third embodiment of a carrier according to the present invention, shown in a fully open configuration.

FIG. 13 shows the case 310 opened by unzipping the zipper 309 to reveal the sub-compartments 307A and 307B defined in the sides 312 and 313 of the case 310. The sub-compartment 307B has a full-size page 100G mounted in the sub-compartment 307B. The sub-compartment 307A has two smaller pages 100H and 1001 mounted in the sub-compartment 307A. The page 100G is secured in the sub-compartment 307B by a strap 315 consisting of the webbing straps 315A and 315B joined by a two-piece buckle 315C.

Figure 14:
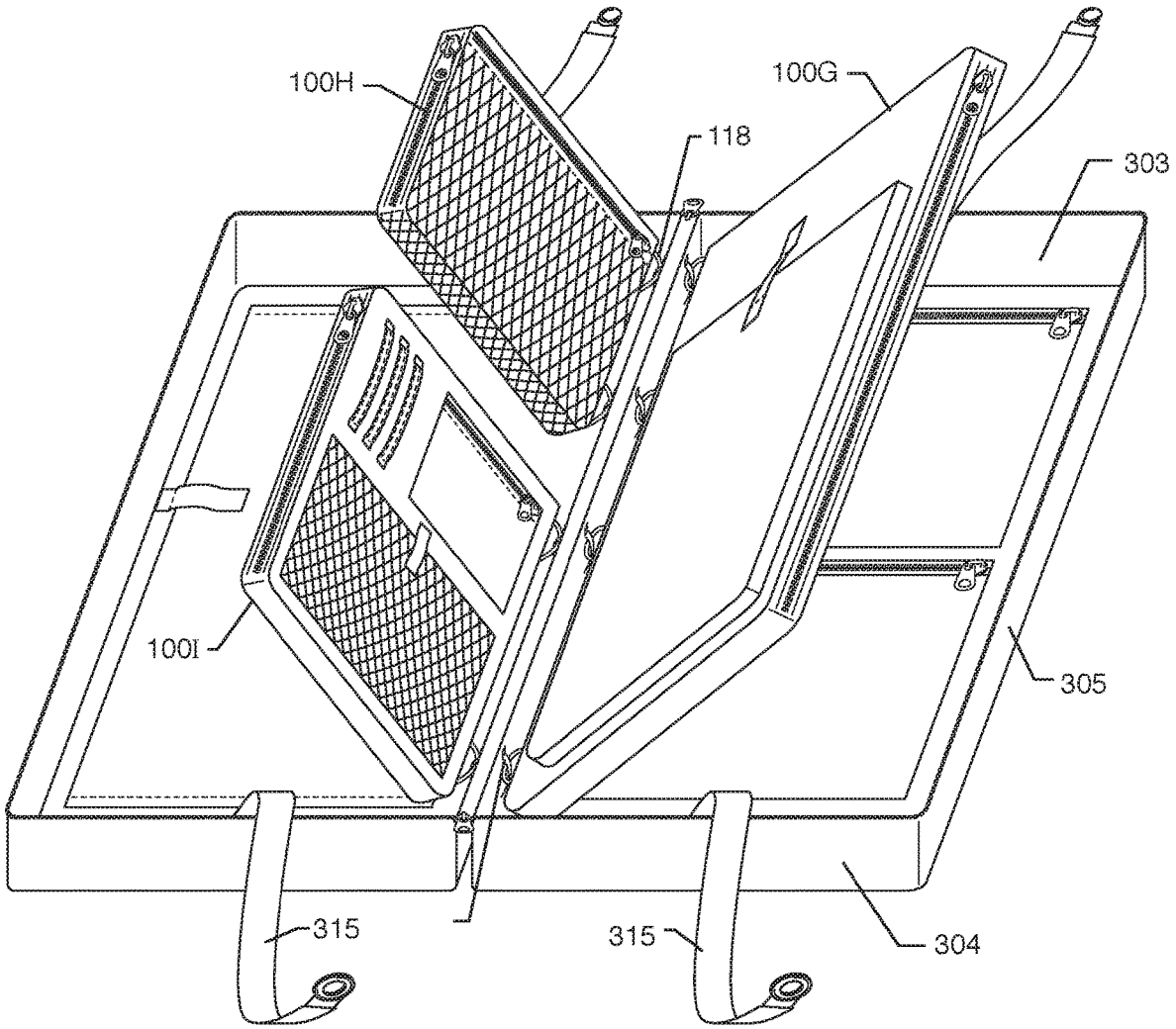
FIG. 14 is a perspective view of the carrier of FIG. 13 showing two detachable "pages" on the left side of the carrier of FIG. 13 rotated toward a detachable "page" on the right side of the carrier of FIG. 13.

Likewise, the pages 100H and 1001 are secured in the sub-compartment 307A by a strap 315 consisting of the webbing straps 315A and 315B joined by a two-piece buckle 315C. Undoing the two-piece buckle 315C will allow the pages 100G-100I to rotate outwardly as shown in FIG. 14.

As an alternative to securing the page 100G in the sub-compartment 307A by the strap 315 and the pages 100H and 1001 in in the sub-compartment 307A by the strap 315, zippers might be employed as in the case 200 of the second embodiment of the invention. Likewise, straps such as the straps 315 of the case 300 of the third embodiment of the invention could be used to secure the pages in the sub-compartments of the case 200.

For each side 312 and 313, the webbing strap 315A is secured to the top wall 303 and the webbing strap 315B is attached to the bottom wall 304. Alternatively, the webbing straps 315A and 315B may be attached to the front wall 301 for the side 312 or the back wall 302 for the side 313.

The pages 100G-100I resemble the pages 100A-100F discussed before in their rectangular outline and ability to receive and carry items. Unlike the pages 100A-100F, the pages 100G-100I are detachably joined to the case 310. The pages 100G-100I have loops 118 attached to one edge of each of them that engage the clips 316 mounted on the left sidewall 306.

Figure 15:
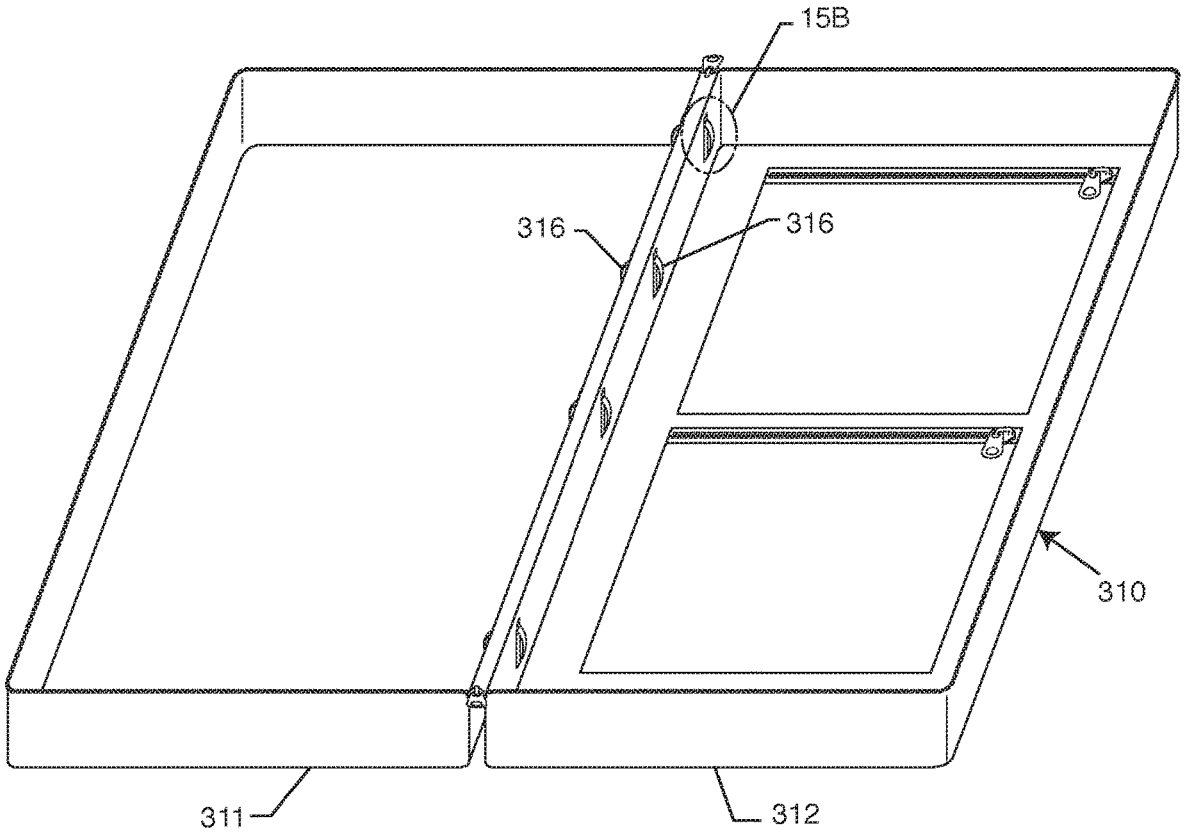
FIG. 15 is a perspective view of the carrier of FIG. 13 with the detachable "pages" removed and showing the clips to which the detachable "pages" may be secured.
Figure 15A:
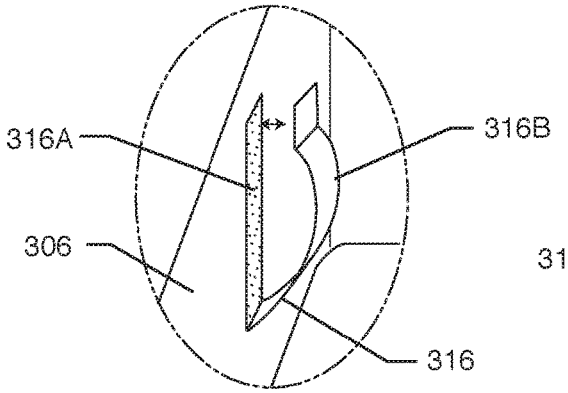
FIG. 15A is an expanded partial view of the carrier of FIG. 13 showing a clip in an open configuration.
Figure 15B:
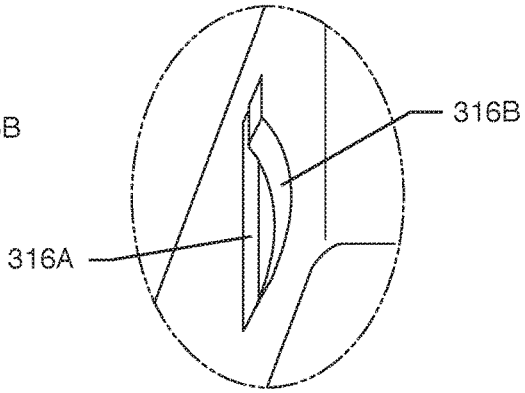
FIG. 15B is an expanded partial view of the carrier of FIG. 13 showing a clip in a closed configuration.

FIG. 15 shows the case 310 without any pages so the clips 316 are more visible. FIG. 15A is an expanded view of one of the clips 316 shown in its open configuration. The open configuration will allow a loop 116 to slide in between the clip and the left sidewall 306. As seen in FIG. 15A, one portion 316A of the clip 316 is embedded or anchored in the left sidewall 306 and another portion 316B of the clip 316 is outside the left sidewall 306. The portions 316A and 316B are biased toward each other to the closed configuration shown in FIG. 15B. The user can rotate the portion 316B away from the anchored portion 316A with her fingers in order to remove or insert a loop 118 attached to a page. It will be noted that other, equivalent, devices may be provided to detachably secure pages in the case such as rails and grooves, hook and loop strips, and the like.

Figure 16A:
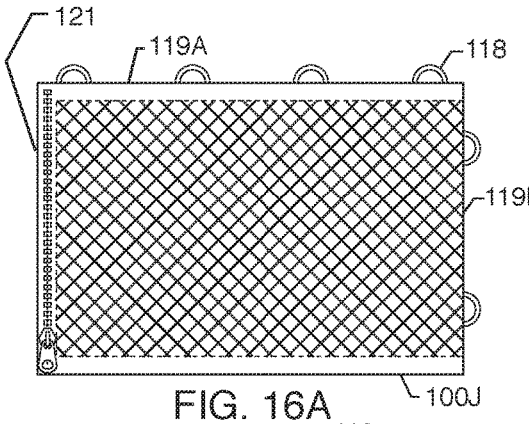
FIGS. 16A-16H are views of several kinds of detachable "pages"

FIGS. 16A-16H show some of the pages that can be designed to fit into the case 310. In FIG. 16A the page 100J has a mesh pocket on one side and loops 118 on the two edges 119A and 119B. The page 100J can be used in cases 310 of different sizes. A smaller case 310 could accommodate the page 100J as a full page for that case, in which case the loops 118 on the longer edge 119A would be attached to the clips 316 in the case 310. A larger case 310 could accommodate the page 100J as a partial page or smaller, in which case the loops 116 on the shorter edge 119B would be attached to the clips 316 in the case 310.

A "full page" is one that extends the height and width of the sub-compartment in which it is mounted and a "partial page" is one that extends less than the height and width of the sub-compartment in which it is mounted. In FIG. 13 the pages 100H and 100I are partial pages and the page 100G is a full page. A page can be either a full page or a partial page depending on the size of the sub-compartment in which it is placed. The page 100J is adapted to be used as either a full page or a partial page.

Figure 16D:
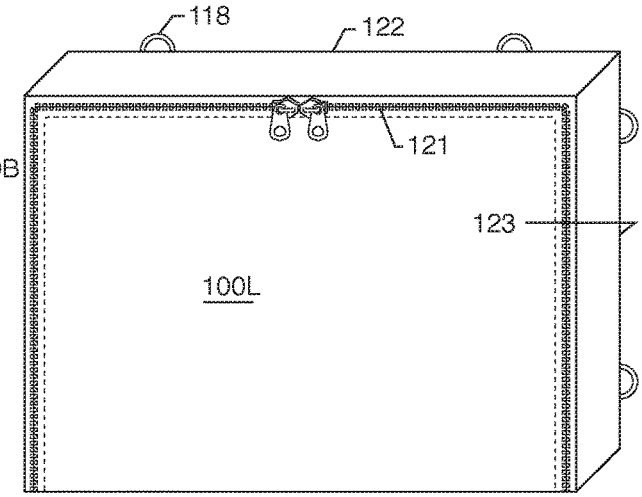
Figure 16B:
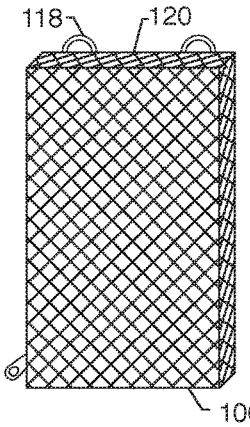
Figure 16C:
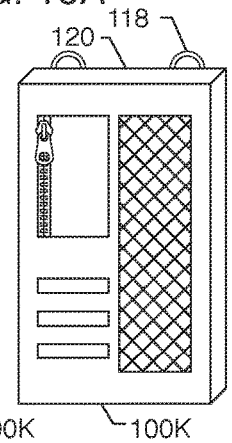

FIGS. 16B and 16C show the page 100K, a smaller page that has a mesh pocket on one side (see FIG. 16B) and various smaller pockets and other devices for holding items on the other side (see FIG. 16C). The page 100K has only two loops 118 on its smaller edge 119 and would not normally be intended to serve as a full page.

FIG. 16D shows the page 100L. The page 100L is a page having a compartment with some depth that is accessed by a zipper 121. The page 100L can be used in cases 310 of different sizes. A smaller case 310 could accommodate the page 100L as a full page for that case, in which case the loops 118 on the longer edge 122 would be attached to the clips 316 in the case 310. A larger case 310 could accommodate the page 100J as a partial page, in which case the loops 118 on the shorter edge 123 would be attached to the clips 316 in the case 310.

Figure 16E:
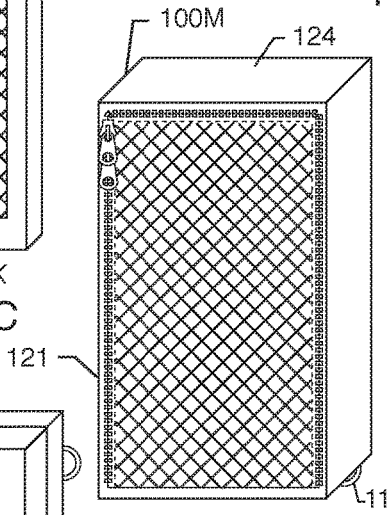

FIG. 16E shows the page 100M. This is a partial page with a deep compartment with a mesh front that is accessed by the zipper 121. Alternatively, the mesh front could be a see-through panel made of a transparent or semi-transparent material.

Figure 16H:
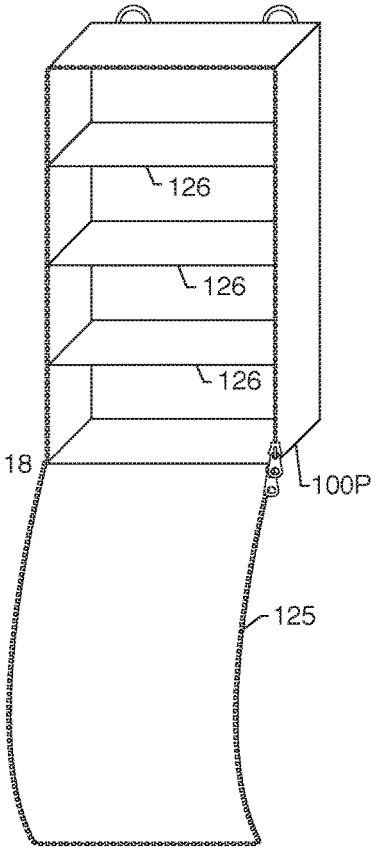
Figure 16G:
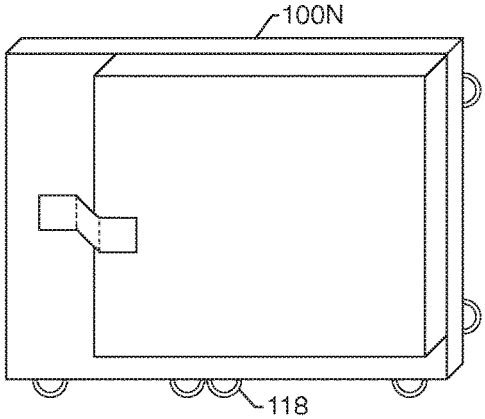
Figure 16F:
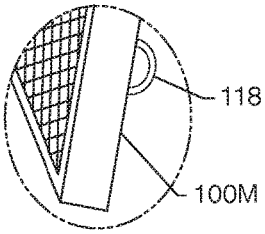

FIG. 16F is an expanded view of a portion of the page 100M showing how and where the loop 118 may be attached to a page having some depth, preferably along an edge of a back wall of the page 100M.

FIG. 16G shows the page 100N, a page having some depth to afford larger compartments for carrying articles. The page 100N can be employed as either a partial page or a full page depending on the size of the sub-compartments 312 and 313 of the case 310.

FIG. 16H shows the page 100P ("100O" is omitted because "O" is easily confused with zero ("0")). The page 100P is a partial page with a deeper compartment with a mesh front accessed by the zipper 125. Alternatively, the mesh front could be a see-through panel made of a transparent or semi-transparent material. The compartment of the page 100P has horizontal dividers 126 that will help in the organization of the items stored in the page 100P.

Figure 17D:
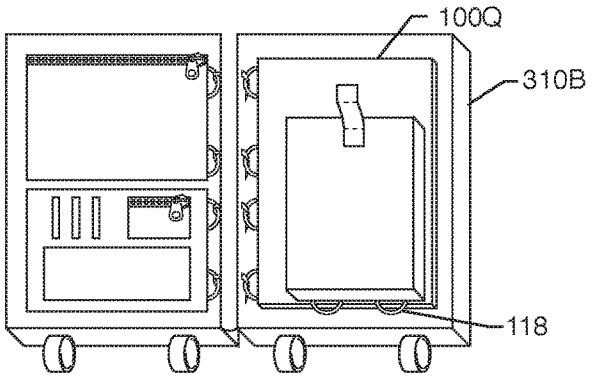
FIG. 17D is a perspective view of the carrier of FIG. 13B in a fully open configuration and showing the "page" that was shown in FIG. 17C occupying the right side of the carrier of FIG. 17B now acting as a "full page" in the carrier of FIG. 17B.
Figure 17C:
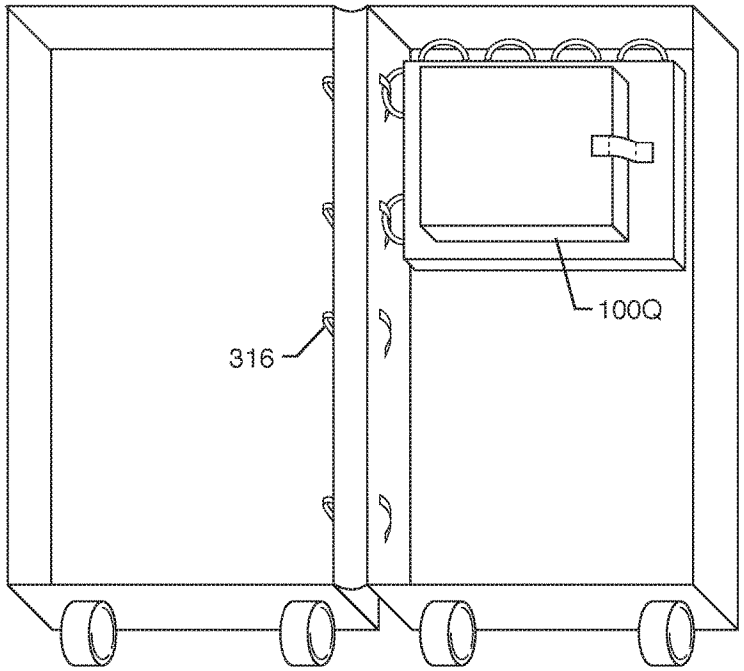
FIG. 17C is a perspective view of the carrier of FIG. 17A in a fully open configuration and showing a "partial page" occupying the right side of the carrier of FIG. 17A.
Figure 17B:
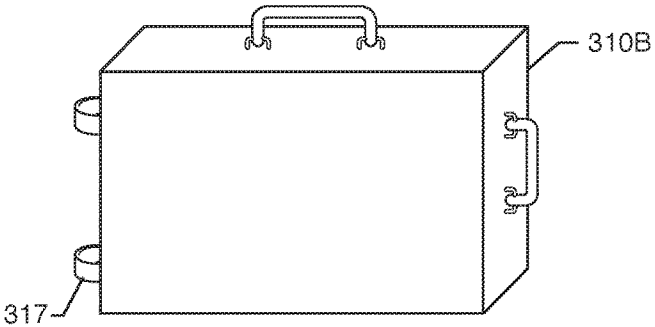
FIG. 17B is a perspective view of a small version of the carrier of FIG. 13 shown in a horizontal configuration for use as a hand-carried case or as a shoulder bag but also suitable for use as a rolling case.
Figure 17A:
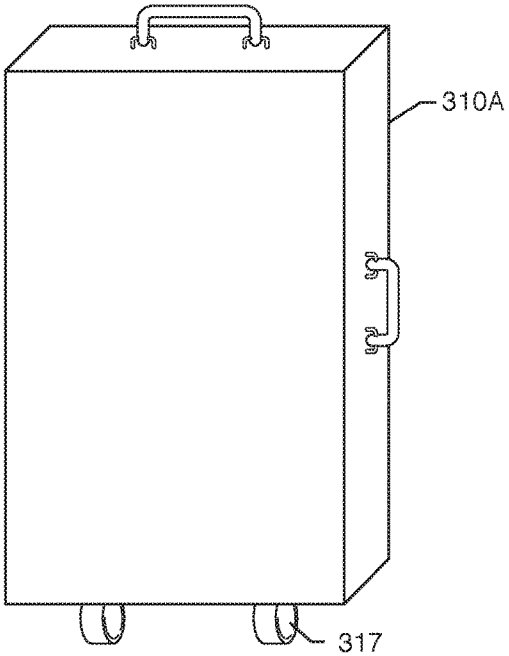
FIG. 17A is a perspective view of a large version of the carrier of FIG. 13 in a vertical configuration for use as a rolling case.

FIGS. 17A and 17B show cases 310 of different sizes. The larger-sized case 310 will be identified by the reference number 310A and the smaller-sized case will be identified by the reference number 310B. Both of the cases 310A and 310B are shown to be rolling cases with wheels 317.

FIGS. 17C and 17D show a page 100Q, which is like the page 100L in that it has a compartment or pocket for holding a laptop or tablet computer and has loops 118 on two edges. Like the page 100L, the page 100Q can be used as a partial page or as a full page depending on the size of the case 310. The page 100Q can be employed as a partial page in the larger case 310A whereas in the smaller case 310B it can be employed as a full page.

Figure 18:
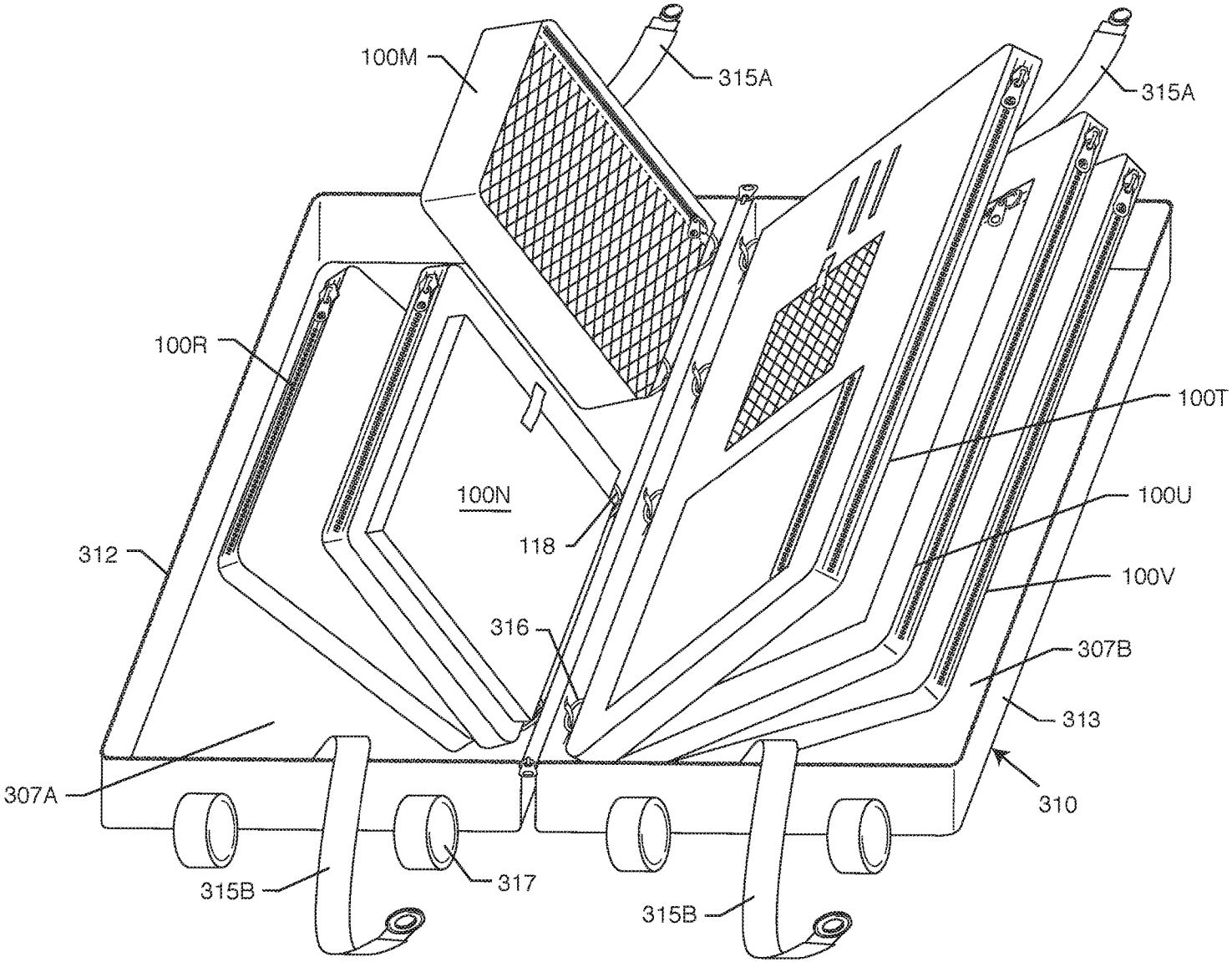
FIG. 18 is a perspective view of the carrier of FIG. 13 shown in the fully open configuration and having three "partial pages" on the left side of the carrier of FIG. 13 rotated to the right and three "full pages" on the right side of the carrier of FIG. 13 rotated to the left.

FIG. 18 shows a case 310 equipped with three partial pages on the left (for the sub-compartment 307A) and three full pages on the right for the sub-compartment 307B). The left side 312, defining the sub-compartment 307A, accommodates the half-page 100M, a deeper page with a mesh front shown in FIG. 16E, next to the page 100N, the laptop holding page shown in FIG. 16G. A page 100R is located below the page 100N. The pages 100N and 100R have a shallower depth than the page 100M and therefore can be stacked one on top of the other while having the same depth overall as the page 100M.

The sub-compartment 307B in the right side 313 of the case 310 holds three full-size pages 100T, 100U, and 100V.

The depth or thickness of each of the pages 100T, 100U, and 100V has been selected so that the combined depth of all three pages 100T, 100U, and 100V will not exceed the depth of the sub-compartment 307B in the side 313 of the case 310.

Figure 19:
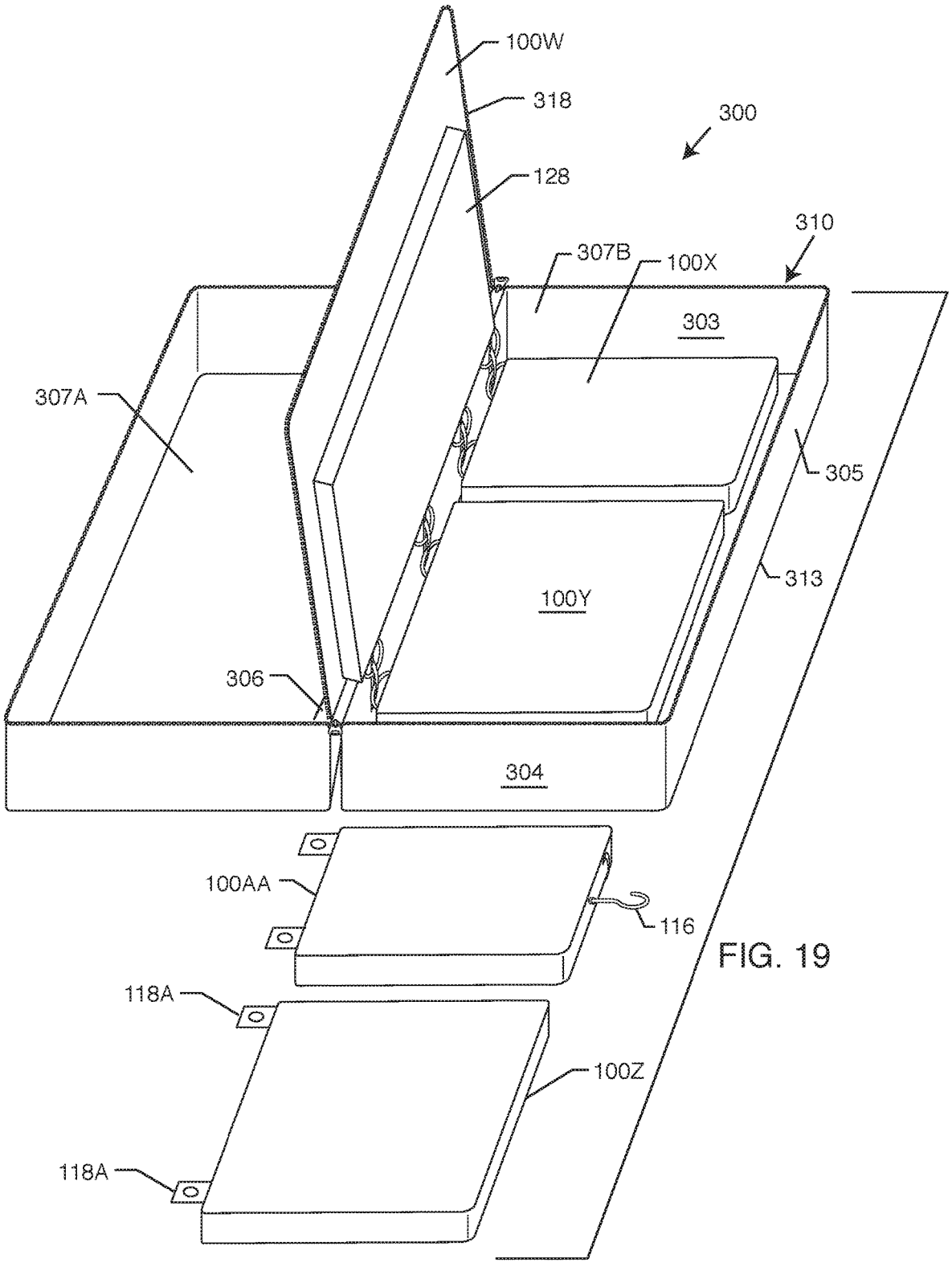
FIG. 19 is a perspective view of the carrier of FIG. 13 with one "full page" and two "partial pages" shown attached to the right side of the carrier of FIG. 13 and two "partial pages" shown detached from the left side of the carrier of FIG. 13.

FIG. 19 shows how pages of differing sizes and shapes might be employed to carry a traveler's equipment in one side (313) of the case 310 of a carrier 300 by the selection of pages of appropriate size and type. The carrier 300 as shown in FIG. 19 is a variation of the carriers 300 shown in FIGS. 13, 14, 15, 17A-17D, and 18 in that the page 100W is not designed to be detachable from the carrier 300. The page 100W is attached to the left sidewall 306 and is detachably connected to the top wall 303, the right sidewall 305, and the bottom wall 304 by the zipper 318. Unzipping the zipper 318 will provide access to the pages underneath the page 100W. The page 100W has one or more pockets 128 on its underside adapted for carrying various technological items such as computer tablets, cables, memory, batteries, and so forth. The remaining pages 100X and 100Y in the sub-compartment 307B are attached using the loops 118 attached to those pages and the clips 316 attached to the left sidewall 306.

The pages 100Z and 100AA have been removed from the sub-compartment 307B and set to the side of the carrier 300 so that the pages layer consisting of pages 100X and 100Y is visible in FIG. 19. The page 100Z is a deep half-page suitable for containing clothes and the page 100AA is a waterproof toiletry kit that may be removed from the carrier 300 and suspended by its hook 126. The pages 100Z and 100AA shown to have connectors 118A that are an alternative version of loop 118.

The lowest layer of pages in the sub-compartment 307B consists of the pages 100X and 100Y. These pages are partial pages as applied to this size of the carrier 300. The page 100Y is adapted to contain a pair of shoes and the page 100X is adapted to contain dirty laundry and for that purpose preferably should have walls made of an airtight material.

The sub-compartment 307A on the left side of the case 300 may be left without pages, as shown in FIG. 19, in order to provide room for containing larger articles or clothing such as suits and coats.

While the invention has been described in conjunction with the preferred embodiments, it will be understood that it is not intended to limit the invention to these embodiments or their particular manner of construction, materials or components. For example, the size and shape of the pages can be varied to accommodate articles of many types. The materials of the pages may be transparent or not and waterproof or not. The pages may define compartments and may have pouches or straps to contain or secure articles. The case of the carrier according to the invention may have a shape other than that of a rectangular parallelepiped as mentioned above The invention is intended to cover alternatives, modifications and equivalents that may be included within the spirit and scope of the invention as defined by the appended claims.

What is claimed is:

1. A kit for providing a carrier for articles, comprising:

a case comprising a front wall, a back wall, a top wall, a bottom wall, a right sidewall, and a left sidewall defining a compartment, a continuous opening defined in the top wall, the bottom wall, and one of the right and left sidewalls whereby the case may open into first and second sides having first and second sub-compartments, the first sub-compartment being defined by the front wall, a portion of the top wall, a portion of the bottom wall, a portion of the right sidewall, and a portion of the left side wall, the second sub-compartment being defined by the back wall, a portion of the top wall, a portion of the bottom wall, a portion of the right sidewall, and a portion of the left side wall, wherein the case may open into the first and second sides when rotating about a hinge provided in the other of the right and left sidewalls, a first page having an edge provided with a loop or a clip for detachable connection to a clip provided between the front wall and the hinge on the portion of the other of the right and left sidewalls defining the first sub-compartment, or to a clip provided between the back wall and the hinge on the portion of the other of the right and left sidewalls defining the second sub-compartment, wherein the first page is adapted to be retained by and rotate about the clip, wherein each of the clips comprises a first portion embedded or anchored in a corresponding sidewall and a second portion of the clip is outside the corresponding sidewall, the first and second portions are biased toward each other, whereby a user can rotate the second portion away from the first portion with the user's fingers in order to remove or insert the loop attached to the first page, wherein the first page is adapted to be contained in one of the first sub-compartment and the second sub-compartment and the first page is also adapted to contain articles.

2. The kit according to claim 1 further comprising:

a strap connected to one or more of the top wall and the bottom wall, the strap being adapted to releaseably secure the first page on a first side of the continuous opening and within the first sub-compartment.

3. The kit according to claim 1 further comprising:

a second page having an edge provided with a loop for detachable connection to one of the clips provided between the front wall and the hinge on the portion of the other of the right and left sidewalls defining the first sub-compartment or to the clip provided between the back wall and the hinge on the portion of the other of the right and left sidewalls defining the second sub-compartment and between the first page and one of the front wall and the back wall, wherein the second page is adapted to rotate about the one of the clips, and wherein the second page is adapted to be contained in one of the first sub-compartment and the second sub-compartment and the second page is also adapted to contain articles.

4. The kit according to claim 3 wherein one of the first and second pages is a page having a height less than the distance within the first sub-compartment between the top wall and the bottom wall.

5. The kit according to claim 3 wherein one of the first and second pages is a page having a height less than the distance within the compartment between the top wall and the bottom wall of the case and is adapted to have a height between the top wall and the bottom wall of a case having smaller dimensions.

6. The kit according to claim 3, wherein a third page having an edge provided with a loop for detachable connection to one of the clips provided between one of the front wall and the back wall and the hinge on the portion of the other of the right and left sidewalls, wherein the third page is adapted to be retained by and rotate about the clip, wherein the third page is adapted to be contained in one of the first and the second sub-compartments and the third page is also adapted to contain articles.

7. The kit according to claim 1 wherein the first page is provided with a pocket sized and adapted to contain a one or more of a laptop computer, a tablet computer, and a smartphone.

8. The kit according to claim 1 wherein the first page is provided with one of a pocket or a strap sized and adapted to contain or carry one or more cables.

9. The kit according to claim 1 wherein the first page is provided with a pocket sized and adapted to contain one or more of a battery or computer memory device.

10. The kit according to claim 1 wherein the first page is provided with a pocket sized and adapted to contain a one or more of a pad of paper, a writing device such as a pen, keys, clothing, or a personal care product.

11. The kit according to claim 1 wherein the first page is provided with a pocket sized and adapted to contain a one or more of a credit card and a passport.

12. The kit according to claim 11 wherein the pocket is made with material that will defeat remote reading of a credit card or a passport by radio frequency identification techniques.

* * * * *